US008322147B2

(12) United States Patent
Hyde et al.

(10) Patent No.: US 8,322,147 B2
(45) Date of Patent: Dec. 4, 2012

(54) METHODS OF MANUFACTURING TEMPERATURE-STABILIZED STORAGE CONTAINERS

(75) Inventors: Roderick A. Hyde, Redmond, WA (US); Edward K. Y. Jung, Bellevue, WA (US); Nathan P. Myhrvold, Medina, WA (US); Clarence T. Tegreene, Bellevue, WA (US); William H. Gates, III, Redmond, WA (US); Charles Whitmer, North Bend, WA (US); Lowell L. Wood, Jr., Bellevue, WA (US)

(73) Assignee: Tokitae LLC, Bellevue, WA (US)

( * ) Notice: Subject to any disclaimer, the term of this patent is extended or adjusted under 35 U.S.C. 154(b) by 0 days.

(21) Appl. No.: 13/199,439

(22) Filed: Aug. 29, 2011

(65) Prior Publication Data

US 2011/0308201 A1 Dec. 22, 2011

Related U.S. Application Data

(63) Continuation of application No. 12/012,490, filed on Jan. 31, 2008, now Pat. No. 8,069,680, and a continuation-in-part of application No. 12/001,757, filed on Dec. 11, 2007, and a continuation-in-part of application No. 12/006,088, filed on Dec. 27, 2007, now Pat. No. 8,215,518, and a continuation-in-part of application No. 12/006,089, filed on Dec. 27, 2007, and a continuation-in-part of application No. 12/008,695, filed on Jan. 10, 2008.

(51) Int. Cl.

| | |
|---|---|
| ***B65B 63/08*** | (2006.01) |
| ***B65B 11/00*** | (2006.01) |
| ***F25D 3/08*** | (2006.01) |

(52) U.S. Cl. ..... 62/60; 62/371; 62/457.1; 53/461; 53/464

(58) Field of Classification Search ..... 62/60, 371, 62/457.1, 457.2; 220/592.2, 592.25, 592.26; 277/650; 428/34.1, 35.9; 53/203, 204, 221, 53/228, 229; 206/528, 531, 532
See application file for complete search history.

(56) References Cited

U.S. PATENT DOCUMENTS 520,584 A 5/1894 Turner (Continued)

FOREIGN PATENT DOCUMENTS

CN 2414742 Y 1/2001

(Continued)

OTHER PUBLICATIONS

PCT International Search Report; Application No. PCT/US2011/001939; Mar. 27, 2012; pp. 1-2.

(Continued)

*Primary Examiner* — Mohammad Ali
*Assistant Examiner* — Daniel C Comings

(57) ABSTRACT

Methods disclosed herein include methods of manufacturing integrally thermally-sealed storage containers. Methods include creating at least one indentation in at least one layer of first thermal barrier sheet, wherein the at least one layer of first thermal barrier sheet includes at least one first ultra efficient insulation material and wherein the at least one indentation is in a size and shape substantially conforming with material to be stored; placing material to be stored within one or more of the at least one indentation; placing at least one layer of second thermal barrier sheet adjacent to the material to be stored, wherein the at least one layer of second thermal barrier sheet includes at least one second ultra efficient insulation material; and creating a thermal seal between at least two layers of thermal barrier sheet, substantially thermally sealing the material to be stored.

20 Claims, 15 Drawing Sheets

U.S. PATENT DOCUMENTS 2,717,937 A 9/1955 Lehr et al.
3,034,845 A 5/1962 Haumann
3,069,045 A 12/1962 Haumann et al.
3,921,844 A 11/1975 Walles
4,003,426 A 1/1977 Best et al.
4,057,029 A 11/1977 Seiter
4,057,101 A 11/1977 Ruka et al.
4,094,127 A 6/1978 Romagnoli
4,184,601 A 1/1980 Stewart et al.
4,312,669 A 1/1982 Boffito et al.
4,358,490 A 11/1982 Nagai
4,388,051 A 6/1983 Dresler et al.
4,402,927 A 9/1983 Von Dardel et al.
4,428,854 A 1/1984 Enjo et al.
4,482,465 A 11/1984 Gray
4,526,015 A 7/1985 Laskaris
4,726,974 A 2/1988 Nowobilski et al.
4,796,432 A 1/1989 Fixsen et al.
4,810,403 A 3/1989 Bivens et al.
4,955,204 A 9/1990 Pehl et al.
4,956,976 A 9/1990 Kral et al.
4,976,308 A 12/1990 Faghri
5,012,102 A 4/1991 Gowlett
5,103,337 A 4/1992 Schrenk et al.
5,116,105 A 5/1992 Hong
5,138,559 A 8/1992 Kuehl et al.
5,245,869 A 9/1993 Clarke et al.
5,261,241 A 11/1993 Kitahara et al.
5,330,816 A 7/1994 Rusek, Jr.
5,355,684 A 10/1994 Guice
5,376,184 A 12/1994 Aspden
5,390,734 A 2/1995 Voorhes et al.
5,444,223 A 8/1995 Blama
5,452,565 A 9/1995 Blom et al.
5,548,116 A 8/1996 Pandelisev
5,563,182 A 10/1996 Epstein et al.
5,580,522 A 12/1996 Leonard et al.
5,590,054 A 12/1996 McIntosh
5,600,071 A 2/1997 Sooriakumar et al.
5,633,077 A 5/1997 Olinger
5,709,472 A 1/1998 Prusik et al.
5,782,344 A 7/1998 Edwards et al.
5,800,905 A 9/1998 Sheridan et al.
5,846,224 A 12/1998 Sword et al.
5,857,778 A 1/1999 Ells
5,900,554 A 5/1999 Baba et al.
5,915,283 A 6/1999 Reed et al.
6,030,580 A 2/2000 Raasch et al.
6,042,264 A 3/2000 Prusik et al.
6,050,598 A 4/2000 Upton
6,209,343 B1 4/2001 Owen
6,212,904 B1 4/2001 Arkharov et al.
6,213,339 B1 4/2001 Lee
6,234,341 B1 5/2001 Tattam
6,272,679 B1 8/2001 Norin
6,287,652 B2 * 9/2001 Speckhals et al. ..... 428/35.2
6,453,749 B1 9/2002 Petrovic et al.
6,485,805 B1 11/2002 Smith et al.
6,571,971 B1 6/2003 Weiler
6,673,594 B1 1/2004 Owen et al.
6,692,695 B1 2/2004 Bronshtein et al.
6,742,673 B2 6/2004 Credle, Jr. et al.
6,751,963 B2 6/2004 Navedo et al.
6,771,183 B2 8/2004 Hunter
6,841,917 B2 1/2005 Potter
6,877,504 B2 4/2005 Schreff et al.
6,967,051 B1 11/2005 Augustynowicz et al.
7,001,656 B2 2/2006 Maignan et al.
7,240,513 B1 7/2007 Conforti
7,258,247 B2 8/2007 Marquez
7,267,795 B2 9/2007 Ammann et al.
7,278,278 B2 10/2007 Wowk et al.
7,596,957 B2 10/2009 Fuhr et al.
7,807,242 B2 * 10/2010 Soerensen et al. ..... 428/35.7
2002/0050514 A1 5/2002 Schein
2002/0083717 A1 7/2002 Mullens et al.
2002/0084235 A1 7/2002 Lake
2002/0130131 A1 9/2002 Zucker et al.
2003/0072687 A1 4/2003 Nehring et al.
2003/0148773 A1 8/2003 Spriestersbach et al.
2004/0035120 A1 2/2004 Brunnhofer
2004/0055313 A1 3/2004 Navedo et al.
2004/0055600 A1 3/2004 Izuchukwu
2004/0103302 A1 5/2004 Yoshimura et al.
2005/0009192 A1 1/2005 Page
2005/0067441 A1 3/2005 Alley
2005/0247312 A1 11/2005 Davies
2005/0274378 A1 12/2005 Bonney et al.
2006/0021355 A1 2/2006 Boesel et al.
2006/0071585 A1 4/2006 Wang
2006/0191282 A1 8/2006 Sekiya et al.
2006/0196876 A1 9/2006 Rohwer
2006/0259188 A1 11/2006 Berg
2007/0041814 A1 2/2007 Lowe
2008/0269676 A1 10/2008 Bieberich et al.
2009/0275478 A1 11/2009 Atkins et al.
2009/0301125 A1 12/2009 Myles et al.
2010/0016168 A1 1/2010 Atkins et al.
2010/0028214 A1 2/2010 Howard et al.
2010/0287963 A1 11/2010 Billen et al.
2011/0117538 A1 5/2011 Niazi

FOREIGN PATENT DOCUMENTS

CN 101073524 A 11/2007
FR 2 621 685 10/1987
GB 2 441 636 A 3/2008
WO WO 99/36725 A1 7/1999

OTHER PUBLICATIONS

Chinese State Intellectual Property Office; Office Action; Chinese Application No. 200980109399.4; dated Aug. 29, 2012; pp. 1-12 (No translation provided).
U.S. Appl. No. 13/385,088, Hyde et al.
U.S. Appl. No. 13/374,218, Hyde et al.
Chinese State Intellectual Property Office; App. No. 200880119777.2; Mar. 30, 2012; pp. 1-10 (no translation available).
U.S. Appl. No. 13/489,058, Bowers et al.
U.S. Appl. No. 13/200,555, Chou et al.
Saes Getters; "St707 Getter Alloy for Vacuum Systems"; printed on Sep. 22, 2011; pp. 1-2; located at http://www.saegetters.com/default.aspx?idPage=212.
U.S. Appl. No. 13/135,126, Deane et al.
U.S. Appl. No. 12/927,982, Deane et al.
U.S. Appl. No. 12/927,981, Chou et al.
U.S. Appl. No. 12/658,579, Deane et al.
U.S. Appl. No. 12/220,439, Hyde et al.
U.S. Appl. No. 12/152,467, Bowers et al.
U.S. Appl. No. 12/152,465, Bowers et al.
U.S. Appl. No. 12/077,322, Hyde et al.
U.S. Appl. No. 12/012,490, Hyde et al.
U.S. Appl. No. 12/008,695, Hyde et al.
U.S. Appl. No. 12/006,089, Hyde et al.
U.S. Appl. No. 12/006,088, Hyde et al.
U.S. Appl. No. 12/001,757, Hyde et al.
3M Monitor Mark™; "Time Temperature Indicators—Providing a visual history of time temperature exposure"; 3M Microbiology; bearing a date of 2006; pp. 1-4; located at 3M.com/microbiology.
Adams, R. O.; "A review of the stainless steel surface"; The Journal of Vacuum Science and Technology A; Bearing a date of Jan.-Mar. 1983; pp. 12-18; vol. 1, No. 1; American Vacuum Society.
Arora, Anubhav; Hakim, Itzhak; Baxter, Joy; Rathnasingham, Ruben; Srinivasan, Ravi; Fletcher, Daniel A.; "Needle-Free Delivery of Macromolecules Across the Skin by Nanoliter-Volume Pulsed Microjets"; PNAS Applied Biological Sciences; Mar. 13, 2007; pp. 4255-4260; vol. 104; No. 11; The National Academy of Sciences USA.
Bang, Abhay T.; Bang, Rani A.; Baitule, Sanjay B.; Reddy, M. Hanimi; Deshmukh, Mahesh D.; "Effect of Home-Based Neonatal Care and Management of Sepsis on Neonatal Mortality: Field Trial in Rural India"; The Lancet; Dec. 4, 1999; pp. 1955-1961; vol. 354; SEARCH (Society for Education, Action, and Research in Community Health).

Bapat, S. L. et al.; "Experimental investigations of multilayer insulation"; Cryogenics; Bearing a date of Aug. 1990; pp. 711-719; vol. 30.
Bapat, S. L. et al.; "Performance prediction of multilayer insulation"; Cryogenics; Bearing a date of Aug. 1990; pp. 700-710; vol. 30.
Barth, W. et al.; "Experimental investigations of superinsulation models equipped with carbon paper"; Cryogenics; Bearing a date of May 1988; pp. 317-320; vol. 28.
Barth, W. et al.; "Test results for a high quality industrial superinsulation"; Cryogenics; Bearing a date of Sep. 1988; pp. 607-609; vol. 28.
Bartl, J., et al.; "Emissivity of aluminium and its importance for radiometric measurement"; Measurement Science Review; Bearing a date of 2004; pp. 31-36; vol. 4, Section 3.
Beavis, L. C.; "Interaction of Hydrogen with the Surface of Type 304 Stainless Steel"; The Journal of Vacuum Science and Technology; Bearing a date of Mar.-Apr. 1973; pp. 386-390; vol. 10, No. 2; American Vacuum Society.
Benvenuti, C.; "Decreasing surface outgassing by thin film getter coatings"; Vacuum; Bearing a date of 1998; pp. 57-63; vol. 50; No. 1-2; Elsevier Science Ltd.
Benvenuti, C.; "Nonevaporable getter films for ultrahigh vacuum applications"; Journal of Vacuum Science Technology A Vacuum Surfaces, and Films; Bearing a date of Jan./Feb. 1998; pp. 148-154; vol. 16; No. 1; American Chemical Society.
Benvenuti, C. et al.; "Obtention of pressures in the 10-14 torr range by means of a Zr V Fe non evaporable getter";Vacuum; Bearing a date of 1993; pp. 511-513; vol. 44; No. 5-7; Pergamon Press Ltd.
Benvenuti, C., et al.; "Pumping characteristics of the St707 nonevaporable getter (Zr 70 V 24.6-Fe 5.4 wt %)"; The Journal of Vacuum Science and Technology A; Bearing a date of Nov.-Dec. 1996; pp. 3278-3282; vol. 14, No. 6; American Vacuum Society.
Berman, A.; "Water vapor in vacuum systems"; Vacuum; Bearing a date of 1996; pp. 327-332; vol. 47; No. 4; Elsevier Science Ltd.
Bernardini, M. et al.; "Air bake-out to reduce hydrogen outgassing from stainless steel"; Journal of Vacuum Science Technology; Bearing a date of Jan./Feb. 1998; pp. 188-193; vol. 16; No. 1; American Chemical Society.
Bo, H. et al.; "Tetradecane and hexadecane binary mixtures as phase change materials (PCMs) for cool storage in district cooling systems"; Energy; Bearing a date of 1999; vol. 24; pp. 1015-1028; Elsevier Science Ltd.
Boffito, C. et al.; "A nonevaporable low temperature activatable getter material"; Journal of Vacuum Science Technology; Bearing a date of Apr. 1981; pp. 1117-1120; vol. 18; No. 3; American Vacuum Society.
Brenzel, Logan; Wolfson, Lara J.; Fox-Rushby, Julia; Miller, Mark; Halsey, Neal A.; "Vaccine-Preventable Diseases—Chapter 20"; Disease Control Priorities in Developing Countries; printed on Oct. 15, 2007; pp. 389-411.
Brown, R.D.; "Outgassing of epoxy resins in vacumm."; Vacuum; Bearing a date of 1967; pp. 25-28; vol. 17; No. 9; Pergamon Press Ltd.
Burns, H. D.; "Outgassing Test for Non-metallic Materials Associated with Sensitive Optical Surfaces in a Space Environment"; MSFC-SPEC-1443; Bearing a date of Oct. 1987; pp. 1-10.
Cabeza, L. F. et al.; "Heat transfer enhancement in water when used as PCM in thermal energy storage"; Applied Thermal Engineering; 2002; pp. 1141-1151; vol. 22; Elsevier Science Ltd.
CDC; "Vaccine Management: Recommendations for Storage and Handling of Selected Biologicals"; Jan. 2007; 16 pages total; Department of Health & Human Services U.S.A.
Chen, Dexiang et al.; "Characterization of the freeze sensitivity of a hepatitis B vaccine"; Human Vaccines; Jan. 2009; pp. 26-32; vol. 5, Issue 1; Landes Bioscience.
Chen, Dexiang, et al.; "Opportunities and challenges of developing thermostable vaccines"; Expert Reviews Vaccines; 2009; pp. 547-557; vol. 8, No. 5; Expert Reviews Ltd.
Chen, G. et al.; "Performance of multilayer insulation with slotted shield"; Cryogenics ICEC Supplement; Bearing a date of 1994; pp. 381-384; vol. 34.
Chen, J. R.; "A comparison of outgassing rate of 304 stainless steel and A6063-EX aluminum alloy vacuum chamber after filling with water"; Journal of Vacuum Science Technology A Vacuum Surfaces and Film; Bearing a date of Mar. 1987; pp. 262-264; vol. 5; No. 2; American Chemical Society.
Chen, J. R. et al.; "An aluminum vacuum chamber for the bending magnet of the SRRC synchrotron light source"; Vacuum; Bearing a date of 1990; pp. 2079-2081; vol. 41; No. 7-9; Pergamon Press PLC.
Chen, J. R. et al.; "Outgassing behavior of A6063-EX aluminum alloy and SUS 304 stainless steel"; Journal of Vacuum Science Technology; Bearing a date of Nov./Dec. 1987; pp. 3422-3424; vol. 5; No. 6; American Vacuum Society.
Chen, J. R. et al.; "Outgassing behavior on aluminum surfaces: Water in vacuum systems"; Journal of Vacuum Science Technology; Bearing a date of Jul./Aug. 1994; pp. 1750-1754; vol. 12; No. 4; American Vacuum Society.
Chen, J. R. et al.; "Thermal outgassing from aluminum alloy vacuum chambers"; Journal of Vacuum Science Technology; Bearing a date of Nov./Dec.1985; pp. 2188-2191; vol. 3; No. 6; American Vacuum Society.
Chiggiato, P.; "Production of extreme high vacuum with non evaporable getters" Physica Scripta; Bearing a date of 1997; pp. 9-13; vol. T71.
Chinese State Intellectual Property Office; First Office Action; App No. 200880119918.0; Jul. 13, 2011.
Chiritescu, Catalin; Cahill, David G.; Nguyen, Ngoc; Johnson, David; Bodapati, Arun; Keblinski, Pawel; Zschack, Paul; "Ultralow Thermal Conductivity in Disordered, Layered WSe2 Crystals; Science"; Jan. 19, 2007; pp. 351-353; vol. 315; The American Association for the Advancement of Science.
Cho, B.; "Creation of extreme high vacuum with a turbomolecular pumping system: A baking approach"; Journal of Vacuum Science Technology; Bearing a date of Jul./Aug. 1995; pp. 2228-2232; vol. 13; No. 4; American Vacuum Society.
Choi, S. et al.; "Gas permeability of various graphite/epoxy composite laminates for cryogenic storage systems"; Composites Part B: Engineering; Bearing a date of 2008; pp. 782-791; vol. 39; Elsevier Science Ltd.
Chun, I. et al.; "Effect of the Cr-rich oxide surface on fast pumpdown to ultrahigh vacuum"; Journal of Vacuum Science Technology A Vacuum, Surfaces, and Films; Bearing a date of Sep./Oct. 1997; pp. 2518-2520; vol. 15; No. 5; American Vacuum Society.
Chun, I. et al.; "Outgassing rate characteristic of a stainless-steel extreme high vacuum system"; Journal of Vacuum Science Technology; Bearing a date of Jul./Aug. 1996; pp. 2636-2640; vol. 14; No. 4; American Vacuum Society.
Cohen, Sharon; Hayes, Janice S. Tordella, Tracey; Puente, Ivan; "Thermal Efficiency of Prewarmed Cotton, Reflective, and Forced—Warm-Air Inflatable Blankets in Trauma Patients"; International Journal of Trauma Nursing; Jan.-Mar. 2002; pp. 4-8; vol. 8; No. 1; The Emergency Nurses Association.
Cole-Parmer; "Temperature Labels and Crayons"; www.coleparmer.com; bearing a date of 1971 and printed on Sep. 27, 2007; p. 1.
Cornell University Coop; "The Food Keeper"; printed on Oct. 15, 2007; 7 pages total (un-numbered).
Crawley, D J. et al.; "Degassing Characteristics of Some 'O' Ring Materials"; Vacuum; Bearing a date of 1963; pp. 7-9; vol. 14; Pergamon Press Ltd.
Csernatony, L.; "The Properties of Viton 'A' Elastomers II. The influence of permeation, diffusion and solubility of gases on the gas emission rate from an O-ring used as an atmospheric seal or high vacuum immersed"; Vacuum; Bearing a date of 1965; pp. 129-134; vol. 16; No. 3; Pergamon Press Ltd.
Daryabeigi, Kamran; "Thermal Analysis and Design Optimization of Multilayer Insulation for Reentry Aerodynamic Heating"; Journal of Spacecraft and Rockets; Jul.-Aug. 2002; pp. 509-514; vol. 39; No. 4; American Institute of Aeronautics and Astronautics Inc.
Day, C.; "The use of active carbons as cryosorbent"; Colloids and Surfaces a Physicochemical and Engineering Aspects; Bearing a date of 2001; pp. 187-206; vol. 187-188; Elsevier Science.
Della Porta, P.; "Gas problem and gettering in sealed-off vacuum devices"; Vacuum; Bearing a date of 1996; pp. 771-777; vol. 47; No. 6-8 Elsevier Science Ltd.
Demko, J. A., et al.; "Design Tool for Cryogenic Thermal Insulation Systems"; Advances in Cryogenic Engineering: Transactions of the Cryogenic Engineering Conference—CEC; Bearing a date of 2008; pp. 145-151; vol. 53; American institute of Physics.
Department of Health and Social Services, Division of Public Health, Section of Community Health and EMS, State of Alaska; Cold Injuries Guidelines—Alaska Multi-Level 2003 Version; bearing dates of 2003 and Jan. 2005; pp. 1-60; located at http://www.chems.alaska.gov.
Dylla, H. F. et al.; "Correlation of outgassing of stainless steel and aluminum with various surface treatments"; Journal of Vacuum Science Technology; Bearing a date of Sep./Oct. 1993; pp. 2623-2636; vol. 11; No. 5; American Vacuum Society.
Edstam, James S. et al.; "Exposure of hepatitis B vaccine to freezing temperatures during transport to rural health centers in Mongolia"; Preventive Medicine; 2004; pp. 384-388; vol. 39; The Institute for Cancer Prevention and Elsevier Inc.
Efe, Emine et al.; "What do midwives in one region in Turkey know about cold chain?"; Midwifery; 2008; pp. 328-334; vol. 24; Elsevier Ltd.
Elsey, R. J. "Outgassing of vacuum material I"; Vacuum; Bearing a date of 1975; pp. 299-306; vol. 25; No. 7; Pergamon Press Ltd.
Elsey, R. J. "Outgassing of vacuum materials II" Vacuum; Bearing a date of 1975; pp. 347-361; vol. 25; No. 8; Pergamon Press Ltd.
Engelmann, G. et al.; "Vacuum chambers in composite material"; Journal of Vacuum Science Technology; Bearing a date of Jul./Aug. 1987; pp. 2337-2341; vol. 5; No. 4; American Vacuum Society.
Ette, Ene I.; "Conscience, the Law, and Donation of Expired Drugs"; The Annals of Pharmacotherapy; Jul./Aug. 2004; pp. 1310-1313; vol. 38.
Eyssa, Y. M. et al.; "Thermodynamic optimization of thermal radiation shields for a cryogenic apparatus"; Cryogenics; Bearing a date of May 1978; pp. 305-307; vol. 18; IPC Business Press.
Ferrotec; "Ferrofluid: Magnetic Liquid Technology"; bearing dates of 2001-2008; printed on Mar. 10, 2008; found at http://www.ferrotec.com/technology/ferrofluid.php.
Fricke, Jochen; Emmerling, Andreas; "Aerogels—Preparation, Properties, Applications"; Structure and Bonding; 1992; pp. 37-87; vol. 77; Springer-Verlag Berlin Heidelberg.
Glassford, A. P. M. et al.; "Outgassing rate of multilayer insulation"; 1978; Bearing a date of 1978; pp. 83-106.
Greenbox Systems; "Thermal Management System"; 2010; Printed on: Feb. 3, 2011; p. 1 of 1; located at http://www.greenboxsystems.com.
Günter, M. M. et al.; "Microstructure and bulk reactivity of the nonevaporable getter $Zr_{57}V_{36}Fe_7$"; J. Vac. Sci. Technol. A; Nov./Dec. 1998; pp. 3526-3535; vol. 16, No. 6; American Vacuum Society.
Gupta, A. K. et al.; "Outgassing from epoxy resins and methods for its reduction"; Vacuum; Bearing a date of 1977; pp. 61-63; vol. 27; No. 12; Pergamon Press Ltd.
Halaczek, T. et al.; "Flat-plate cryostat for measurements of multilayer insulation thermal conductivity"; Cryogenics; Bearing a date of Oct. 1985; pp. 593-595; vol. 25; Butterworth & Co. Ltd.
Halaczek, T. et al.; "Unguarded cryostat for thermal conductivity measurements of multilayer insulations"; Cryogenics; Bearing a date of Sep. 1985; pp. 529-530; vol. 25; Butterworth & Co. Ltd.
Halaczek, T. L. et al.; "Heat transport in self-pumping multilayer insulation"; Cryogenics; Bearing a date of Jun. 1986; pp. 373-376; vol. 26; Butterworth & Co. Ltd.
Halaczek, T. L. et al.; "Temperature variation of thermal conductivity of self-pumping multilayer insulation"; Cryogenics; Bearing a date of Oct. 1986; pp. 544-546.; vol. 26; Butterworth & Co. Ltd.
Halldórsson, Arni, et al.; "The sustainable agenda and energy efficiency: Logistics solutions and supply chains in times of climate change"; International Journal of Physical Distribution & Logistics Management; Bearing a date of 2010; pp. 5-13; vol. 40; No. ½; Emerald Group Publishing Ltd.
Halliday, B. S.; "An introduction to materials for use in vacuum"; Vacuum; Bearing a date of 1987; pp. 583-585; vol. 37; No. 8-9; Pergamon Journals Ltd.
Hedayat, A., et al.; "Variable Density Multilayer Insulation for Cryogenic Storage"; Bearing a date of 2000; pp. 1-10.
Hipgrave, David B. et al.; "Immunogenicity of a Locally Produced Hepatitis B Vaccine With the Birth Dose Stored Outside the Cold Chain in Rural Vietnam"; Am. J. Trop. Med. Hyg.; 2006; pp. 255-260; vol. 74, No. 2; The American Society of Tropical Medicine and Hygiene.
Hipgrave, David B. et al.; "Improving birth dose coverage of hepatitis B vaccine"; Bulletin of the World Health Organization; Jan. 2006; pp. 65-71; vol. 84, No. 1; World Health Organization.
Hirohata, Y.; "Hydrogen desorption behavior of aluminium materials used for extremely high vacuum chamber"; Journal of Vacuum Science Technology; Bearing a date of Sep./Oct. 1993; pp. 2637-2641; vol. 11; No. 5; American Vacuum Society.
Hobson, J. P. et al.; "Pumping of methane by St707 at low temperatures"; J. Vac. Sci. Technol. A; May/Jun. 1986; pp. 300-302; vol. 4, No. 3; American Vacuum Society.
Holtrop, K. L. et al.; "High temperature outgassing tests on materials used in the DIII-D tokamak"; Journal of Vacuum Science Technology; Bearing a date of Jul./Aug. 2006; pp. 1572-; vol. 24; No. 4; American Vacuum Society.
Hong, S. et al.; "Investigation of gas species in a stainless steel ultrahigh vacuum chamber with hot cathode ionization gauges"; Measurement Science and Technology; Bearing a date of 2004; pp. 359-364; vol. 15; IOP Science.
Horgan, A. M., et al.; "Hydrogen and Nitrogen Desorption Phenomena Associated with a Stainless Steel 304 Low Energy Electron Diffraction (LEED) and Molecular Beam Assembly"; The Journal of Vacuum Science and Technology; Bearing a date of Jul.-Aug. 1972; pp. 1218-1226; vol. 9, No. 4.
Ishikawa, Y.; "An overview of methods to suppress hydrogen outgassing rate from austenitic stainless steel with reference to UHV and EXV"; Vacuum; Bearing a date of 2003; pp. 501-512; vol. 69; No. 4; Elsevier Science Ltd.
Ishikawa, Y. et al.; "Reduction of outgassing from stainless surfaces by surface oxidation"; Vacuum; Bearing a date of 1990; pp. 1995-1997; vol. 4; No. 7-9; Pergamon Press PLC.
Ishimaru, H.; "All-aluminum-alloy ultrahigh vacuum system for a large-scale electron-positron collider"; Journal of Vacuum Science Technology; Bearing a date of Jun. 1984; pp. 1170-1175; vol. 2; No. 2; American Vacuum Society.
Ishimaru, H.; "Aluminium alloy-sapphire sealed window for ultrahigh vacuum"; Vacuum; Bearing a date of 1983; pp. 339-340.; vol. 33; No. 6; Pergamon Press Ltd.
Ishimaru, H.; "Bakeable aluminium vacuum chamber and bellows with an aluminium flange and metal seal for ultra-high vacuum"; Journal of Vacuum Science Technology; Bearing a date of Nov./Dec. 1978; pp. 1853-1854; vol. 15; No. 6; American Vacuum Society.
Ishimaru, H.; "Ultimate pressure of the order of 10-13 Torr in an aluminum alloy vacuum chamber"; Journal of Vacuum Science and Technology; Bearing a date of May/Jun. 1989; pp. 2439-2442; vol. 7; No. 3; American Vacuum Society.
Ishimaru, H. et al.; "All Aluminum Alloy Vacuum System for the TRISTAN e+ e−Storage"; IEEE Transactions on Nuclear Science; Bearing a date of Jun. 1981; pp. 3320-3322; vol. NS-28; No. 3.
Ishimaru, H. et al.; "Fast pump-down aluminum ultrahigh vacuum system"; Journal of Vacuum Science Technology; Bearing a date of May/Jun. 1992; pp. 547-552 ; vol. 10; No. 3; American Vacuum Society.
Ishimaru, H. et al.; "Turbomolecular pump with an ultimate pressure of 10-12 Ton"; Journal of Vacuum Science Technology; Bearing a date of Jul./Aug. 1994; pp. 1695-1698; vol. 12; No. 4; American Vacuum Society.
Jacob, S. et al.; "Investigations into the thermal performance of multilayer insulation (300-77 K) Part 1: Calorimetric studies"; Cryogenics; Bearing a date of 1992; pp. 1137-1146; vol. 32; No. 12; Butterworth-Heinemann Ltd.
Jacob, S. et al.; "Investigations into the thermal performance of multilayer insulation (300-77 K) Part 2: Thermal analysis"; Cryogenics; Bearing a date of 1992; pp. 1147-1153; vol. 32; No. 12; Butterworth-Heinemann Ltd.
JAMC; "Preventing Cold Chain Failure: Vaccine Storage and Handling"; JAMC; Oct. 26, 2004; p. 1050; vol. 171; No. 9; Canadian Medical Association.
Jenkins, C. H. M.; "Gossamer spacecraft: membrane and inflatable structures technology for space applications"; AIAA; Bearing a date of 2000; pp. 503-527; vol. 191.

Jhung, K. H. C. et al.; "Achievement of extremely high vacuum using a cryopump and conflat aluminium"; Vacuum; Bearing a date of 1992; pp. 309-311; vol. 43; No. 4; Pergamon Press PLC.
Jorgensen, Pernille; Chanthap, Lon; Rebueno, Antero; Tsuyuoka, Reiko; Bell, David; "Malaria Rapid Diagnostic Tests in Tropical Climates: The Need for a Cool Chain"; American Journal of Tropical Medicine and Hygiene; 2006; pp. 750-754; vol. 74; No. 5; The American Society of Tropical Medicine and Hygiene.
Kato, S. et al.; "Achievement of extreme high vacuum in the order of 10-10 Pa without baking of test chamber"; Journal of Vacuum Science Technology; Bearing a date of May/Jun. 1990; pp. 2860-2864; vol. 8 ; No. 3; American Vacuum Society.
Keller, C. W., et al.; "Thermal Performance of Multilayer Insulations, Final Report, Contract NAS 3-14377"; Bearing a date of Apr. 5, 1974; pp. 1-446.
Keller, K. et al.; "Application of high temperature multilayer insulations"; Acta Astronautica ; Bearing a date of 1992; pp. 451-458; vol. 26; No. 6; Pergamon Press Ltd.
Kendal, Alan P. et al.; "Validation of cold chain procedures suitable for distribution of vaccines by public health programs in the USA"; Vaccine; 1997; pp. 1459-1465; vol. 15, No. 12/13; Elsevier Science Ltd.
Khemis, O. et al.; "Experimental analysis of heat transfers in a cryogenic tank without lateral insulation"; Applied Thermal Engineering; 2003; pp. 2107-2117; vol. 23; Elsevier Ltd.
Kishiyama, K., et al.; "Measurement of Ultra Low Outgassing Rates for NLC UHV Vacuum Chambers"; Proceedings of the 2001 Particle Accelerator Conference, Chicago; Bearing a date of 2001; pp. 2195-2197; IEEE.
Koyatsu, Y. et al. "Measurements of outgassing rate from copper and copper alloy chambers"; Vacuum; Bearing a date of 1996; pp. 709-711; vol. 4; No. 6-8; Elsevier Science Ltd.
Kristensen, D. et al.; "Stabilization of vaccines: Lessons learned"; Human Vaccines; Bearing a date of Mar. 2010; pp. 227-231; vol. 6; No. 3; Landes Bioscience.
Kropschot, R. H.; "Multiple layer insulation for cryogenic applications"; Cryogenics; Bearing a date of Mar. 1961; pp. 135-135; vol. 1.
Levin, Carol E.; Nelson, Carib M.; Widjaya, Anton; Moniaga, Vanda; Anwar, Chairiyah; "The Costs of Home Delivery of a Birth Dose of Hepatitis B Vaccine in a Prefilled Syringe in Indonesia"; Bulletin of the World Health Organization; Jun. 2005; pp. 456-461 + 1 pg. Addenda; vol. 83; No. 6.
Li, Y.; "Design and pumping characteristics of a compact titanium—vanadium non-evaporable getter pump"; Journal of Vacuum Science Technology; Bearing a date of May/Jun. 1998; pp. 1139-1144; vol. 16; No. 3; American Vacuum Society.
Li, Yang et al.; "Study on effect of liquid level on the heat leak into vertical cryogenic vessels"; Cryogenics; 2010; pp. 367-372; vol. 50; Elsevier Ltd.
Little, Arthur D.; "Liquid Propellant Losses During Space Flight, Final Report on Contract No. NASw-615"; Bearing a date of Oct. 1964; pp. 1-315.
Liu, Y. C. et al.; "Thermal outgassing study on aluminum surfaces"; Vacuum; Bearing a date of 1993; pp. 435-437; vol. 44; No. 5-7; Pergamon Press Ltd.
Llanos-Cuentas, A.; Campos, P.; Clendenes, M.; Canfield. C.J.; Hutchinson, D.B.A.; "Atovaquone and Proguanil Hydrochloride Compared with Chloroquine or Pyrimethamine/Sulfadoxine for Treatment of Acute Plasmodium Falciparum Malaria in Peru"; The Brazilian Journal of Infectious Diseases; 2001; pp. 67-72; vol. 5; No. 2; The Brazilian Journal of Infectious Diseases and Contexto Publishing.
Lockheed Missiles & Space Company; "High-Performance Thermal Protection Systems, Contract NAS 8-20758, vol. II"; Bearing a date of Dec. 31, 1969; pp. 1-117.
Lockman, Shahin; Ndase, P.; Holland, D.; Shapiro, R.; Connor, J.; Capparelli, E.; "Stability of Didanosine and Stavudine Pediatric Oral Solutions and Kaletra Capsules at Temperatures from 4° C to 55° C"; 12th Conference on Retroviruses and Opportunistic Infections, Boston, Massachusetts; Feb. 22-25, 2005; p. 1; Foundation for Retrovirology and Human Health.
Londer, H. et al.; "New high capacity getter for vacuum insulated mobile LH2 storage tank systems"; Vacuum; Bearing a date of 2008; pp. 431-434; vol. 82; No. 4; Elsevier Ltd.
Ma, Kun-Quan; and Liu, Jing; "Nano liquid-metal fluid as ultimate coolant"; Physics Letters A; bearing dates of Jul. 10, 2006, Sep. 9, 2006, Sep. 18, 2006, Sep. 26, 2006, and Jan. 29, 2007; pp. 252-256; vol. 361, Issue 3; Elsevier B.V.
Magennis, Teri et al. "Pharmaceutical Cold Chain: A Gap in the Last Mile—Part 1. Wholesaler/Distributer: Missing Audit Assurance"; Pharmaceutical & Medical Packaging News; Sep. 2010; pp. 44, 46-48, and 50; pmpnews.com.
Matolin, V. et al.; "Static Sims study of TiZrV NEG activation"; Vacuum; 2002; pp. 177-184; vol. 67; Elsevier Science Ltd.
Matsuda, A. et al.; "Simple structure insulating material properties for multilayer insulation"; Cryogenics; Bearing a date of Mar. 1980; pp. 135-138; vol. 20; IPC Business Press.
Matthias, Dipika M., et al.; "Freezing temperatures in the vaccine cold chain: A systematic literature review"; Vaccine; 2007; pp. 3980-3986; vol. 25; Elsevier Ltd.
Mikhalchenko, R. S. et al.; "Study of heat transfer in multilayer insulations based on composite spacer materials."; Cryogenics; Bearing a date of Jun. 1983; pp. 309-311; vol. 23; Butterworth & Co. Ltd.
Mikhalchenko, R. S. et al.; "Theoretical and experimental investigation of radiative-conductive heat transfer in multilayer insulation"; Cryogenics; Bearing a date of May 1985; pp. 275-278; vol. 25; Butterworth & Co. Ltd.
Miki, M. et al.; "Characteristics of extremely fast pump-down process in an aluminum ultrahigh vacuum system"; Journal of Vacuum Science Technology; Bearing a date of Jul./Aug. 1994; pp. 1760-1766; vol. 12; No. 4; American Vacuum Societyl. M. Miki, K. Itoh, N. Enomoto, H. Ishimaru, Journal of Vacuum Science Technology a Vacuum Surfaces and Films 94112, 1760-1766 (1994).
Mohri, M. et al.; "Surface study of Type 6063 aluminium alloys for vacuum chamber materials"; Vacuum; Bearing a date of 1984; pp. 643-647; vol. 34; No. 6; Pergamon Press Ltd.
Moonasar, Devanand; Goga, Ameena Ebrahim; Frean, John; Kruger, Philip; Chandramohan; Daniel; "An Exploratory Study of Factors that Affect the Performance and Usage of Rapid Diagnostic Tests for Malaria in the Limpopo Province, South Africa"; Malaria Journal; Jun. 2007; pp. 1-5; vol. 6; No. 74; Moonasar et al.; licensee BioMed Central Ltd.
Moshfegh, B.; "A New Thermal Insulation System for Vaccine Distribution; Journal of Thermal Insulation"; Jan. 1992; pp. 226-247; vol. 15; Technomic Publishing Co., Inc.
Mukugi, K. et al.; "Characteristics of cold cathode gauges for outgassing measurements in uhv range"; Vacuum; Bearing a date of 1993; pp. 591-593; vol. 44; No. 5-7; Pergamon Press Ltd.
Nelson, Carib M. et al.; "Hepatitis B vaccine freezing in the Indonesian cold chain: evidence and solutions"; Bulletin of the World Health Organization; Feb. 2004; pp. 99-105 (plus copyright page); vol. 82, No. 2; World Health Organization.
Nemanič, V.; "Outgassing of thin wall stainless steel chamber"; Vacuum; Bearing a date of 1998; pp. 431-437; vol. 50; No. 3-4; Elsevier Science Ltd.
Nemanič, V.; "Vacuum insulating panel"; Vacuum; bearing a date of 1995; pp. 839-842; vol. 46; No. 8-10; Elsevier Science Ltd.
Nemanič, V. et al.; "Anomalies in kinetics of hydrogen evolution from austenitic stainless steel from 300 to 1000° C"; Journal of Vacuum Science Technology; Bearing a date of Jan./Feb. 2001; pp. 215-222; vol. 19; No. 1; American Vacuum Society.
Nemanič, V. et al.; "Outgassing in thin wall stainless steel cells"; Journal of Vacuum Science Technology; Bearing a date of May/Jun. 1999; pp. 1040-1046; vol. 17; No. 3; American Vacuum Society.
Nemanič, Vincenc, et al.; "A study of thermal treatment procedures to reduce hydrogen outgassing rate in thin wall stainless steel cells"; Vacuum; Bearing a date of 1999; pp. 277-280; vol. 53; Elsevier Science Ltd.
Nemanič, Vincenc, et al.; "Experiments with a thin-walled stainless-steel vacuum chamber"; The Journal of Vacuum Science and Technology A; Bearing a date of Jul.-Aug. 2000; pp. 1789-1793; vol. 18, No. 4; American Vacuum Society.

Nemanič, Vincenc, et al.; "Outgassing of a thin wall vacuum insulating panel"; Vacuum; Bearing a date of 1998; pp. 233-237; vol. 49, No. 3; Elsevier Science Ltd.
Nolan, Timothy D. C.; Hattler, Brack G.; Federspiel, William J.; "Development of a Balloon Volume Sensor for Pulsating Balloon Catheters"; ASAIO Journal; 2004; pp. 225-233; vol. 50; No. 3; American Society of Artificial Internal Organs.
Odaka, K.; "Dependence of outgassing rate on surface oxide layer thickness in type 304 stainless steel before and after surface oxidation in air"; Vacuum; Bearing a date of 1996; pp. 689-692; vol. 47; No. 6-8; Elsevier Science Ltd.
Odaka, K. et al.;"Effect of baking temperature and air exposure on the outgassing rate of type 316L stainless steel"; Journal of Vacuum Science Technology; Bearing a date of Sep./Oct. 1987; pp. 2902-2906; vol. 5; No. 5; American Vacuum Society.
Okamura, S. et al.; "Outgassing measurement of finely polished stainless steel"; Journal of Vacuum Science Technology; Bearing a date of Jul./Aug. 1991; pp. 2405-2407; vol. 9; No. 4; American Vacuum Society.
PATH—A Catalyst for Global Health; "Uniject™ Device—The Radically Simple Uniject™ Device—Rethinking the Needle to Improve Immunization"; bearing dates of 1995-2006; printed on Oct. 11, 2007; pp. 1-2; located at http://www.path.org/projects/uniject.php; PATH Organization.
Patrick, T. J.; "Outgassing and the choice of materials for space instrumentation"; Vacuum; Bearing a date of 1973; pp. 411-413; vol. 23; No. 11; Pergamon Press Ltd.
Patrick, T. J.; "Space environment and vacuum properties of spacecraft materials"; Vacuum; Bearing a date of 1981; pp. 351-357; vol. 31; No. 8-9; Pergamon Press Ltd.
Pau, Alice K.; Moodley, Neelambal K.; Holland, Diane T.; Fomundam, Henry; Matchaba, Gugu U.; and Capparelli, Edmund V.; "Instability of lopinavir/ritonavir capsules at ambient temperatures in sub-Saharan Africa: relevance to WHO antiretroviral guidelines"; AIDS; Bearing dates of 2005, Mar. 29, 2005, and Apr. 20, 2005; pp. 1229-1236; vol. 19, No. 11; Lippincott Williams & Wilkins [This entry replaces VALMARY].
PCT International Search Report; International App. No. PCT/US 11/00234; Jun. 9, 2011; pp. 1-4.
PCT International Search Report; International App. No. PCT/US09/01715; Jan. 8, 2010; pp. 1-2.
PCT International Search Report; International App. No. PCT/US08/13646; Apr. 9, 2009; pp. 1-2.
PCT International Search Report; International App. No. PCT/US08/13648; Mar. 13, 2009; pp. 1-2.
PCT International Search Report; International App. No. PCT/US08/13642; Feb. 26, 2009; pp. 1-2.
PCT International Search Report; International App. No. PCT/US08/13643; Feb. 20, 2009; pp. 1-2.
Pekala, R. W.; "Organic Aerogels From the Polycondensation of Resorcinol With Formaldehyde"; Journal of Materials Science; Sep. 1989; pp. 3221-3227; vol. 24; No. 9; Springer Netherlands.
Pickering, Larry K.; Wallace, Gregory; Rodewald, Lance; "Too Hot, Too Cold: Issues with Vaccine Storage"; Pediatrics® —Official Journal of the American Academy of Pediatrics; 2006; pp. 1738-1739 (4 pages total, incl. cover sheet and end page); vol. 118; American Academy of Pediatrics.
Poole, K. F. et al.; "Hialvac and Teflon outgassing under ultra-high vacuum conditions"; Vacuum; Bearing a date of Jun. 30, 1980; pp. 415-417; vol. 30; No. 10; Pergamon Press Ltd.
Post, Richard F.; "Maglev: A New Approach"; Scientific American; Jan. 2000; pp. 82-87; Scientific American, Inc.
Program for Appropriate Technology in Health (PATH); "The Radically Simple Uniject Device"; PATH—Reflections on Innovations in Global Health; printed on Jan. 26, 2007; pp. 1-4; located at www.path.org.
Pure Temp; "Technology"; Printed on: Feb. 9, 2011; p. 1-3; located at http://puretemp.com/technology.html.
Redhead, P. A.; "Recommended practices for measuring and reporting outgassing data"; Journal of Vacuum Science Technology; Bearing a date of Sep./Oct. 2002; pp. 1667-1675; vol. 20; No. 5; American Vacuum Society.
Reeler, Anne V.; Simonsen, Lone; Health Access International; "Unsafe Injections, Fatal Infections"; Bill and Melinda Gates Children's Vaccine Program Occasional Paper #2; May 2000; pp. 1-8; located at www.ChildrensVaccine.org/html/safe_injection.htm.
Ren, Qian et al.; "Evaluation of an Outside-The-Cold-Chain Vaccine Delivery Strategy in Remote Regions of Western China"; Public Health Reports; Sep.-Oct. 2009; pp. 745-750; vol. 124.
Risha, Peter G.; Shewiyo, Danstan; Msami, Amani; Masuki, Gerald; Vergote, Geert; Vervaet, Chris; Remon, Jean Paul; "In vitro Evaluation of the Quality of Essential Drugs on the Tanzanian Market"; Tropical Medicine and International Health; Aug. 2002; pp. 701-707; vol. 7; No. 8; Blackwell Science Ltd.
Rogers, Bonnie et al.; "Vaccine Cold Chain—Part 1. Proper Handling and Storage of Vaccine"; AAOHN Journal; 2010; pp. 337-344 (plus copyright page); vol. 58, No. 8; American Association of Occupational Health Nurses, Inc.
Rogers, Bonnie et al.; Vaccine Cold Chain—Part 2. Training Personnel and Program Management; AAOHN Journal; 2010; pp. 391-402 (plus copyright page); vol. 58, No. 9; American Association of Occupational Health Nurses, Inc.
Rutherford, S; "The Benefits of Viton Outgassing"; Bearing a date of 1997; pp. 1-5; Duniway Stockroom Corp.
Saito, K. et al.; "Measurement system for low outgassing materials by switching between two pumping paths"; Vacuum; Bearing a date of 1996; pp. 749-752; vol. 47; No. 6-8; Elsevier Science Ltd.
Saitoh, M. et al.; "Influence of vacuum gauges on outgassing rate measurements" ; Journal of Vacuum Science Technology; Bearing a date of Sep./Oct. 1993; pp. 2816-2821; vol. 11; No. 5; American Vacuum Society.
Santhanam, S. M. T. J. et al. ;"Outgassing rate of reinforced epoxy and its control by different pretreatment methods"; Vacuum; Bearing a date of 1978; pp. 365-366; vol. 28; No. 8-9; Pergamon Press Ltd.
Sasaki, Y. T.; "Reducing SS 304/316 hydrogen outgassing to 2×10-15torr 1/cm 2s"; Journal of Vacuum Science Technology; Bearing a date of Jul./Aug. 2007; pp. 1309-1311; vol. 25; No. 4; American Vacuum Society.
Sasaki, Y. Tito; "A survey of vacuum material cleaning procedures: A subcommittee report of the American Vacuum Society Recommended Practices Committee"; The Journal of Vacuum Science and Technology A; Bearing a date of May-Jun. 1991; pp. 2025-2035; vol. 9, No. 3; American Vacuum Society.
Scurlock, R. G. et al.; "Development of multilayer insulations with thermal conductivities below 0.1 μW cm-1 K-1"; Cryogenics; Bearing a date of May 1976; pp. 303-311; vol. 16.
Setia, S. et al.; "Frequency and causes of vaccine wastage"; Vaccine ; Bearing a date of 2002; pp. 1148-1156; vol. 20; Elsevier Science Ltd.
Seto, Joyce; Marra, Fawziah; "Cold Chain Management of Vaccines"; Continuing Pharmacy Professional Development Home Study Program; Feb. 2005; pp. 1-19; University of British Columbia.
Shockwatch; "Environmental Indicators"; printed on Sep. 27, 2007; pp. 1-2; located at www.shockwatch.com.
Shu, Q. S. et al.; "Heat flux from 277 to 77 K through a few layers of multilayer insulation"; Cryogenics; Bearing a date of Dec. 1986; pp. 671-677; vol. 26; Butterworth & Co. Ltd.
Shu, Q. S. et al.; "Systematic study to reduce the effects of cracks in multilayer insulation Part 1: Theoretical model"; Cryogenics; Bearing a date of May 1987; pp. 249-256; vol. 27; Butterworth & Co. Ltd.
Shu, Q. S. et al.; "Systematic study to reduce the effects of cracks in multilayer insulation Part 2: experimental results"; Cryogenics; Bearing a date of Jun. 1987; pp. 298-311; vol. 27; No. 6; Butterworth & Co. Ltd.
Spur Industries Inc.; "The Only Way to Get Them Apart is to Melt Them Apart"; 2006; pp. 1-3; located at http://www.spurind.com/applications.php.
Suemitsu, M. et al.; "Development of extremely high vacuums with mirror-polished Al-alloy chambers"; Vacuum; Bearing a date of 1993; pp. 425-428; vol. 44; No. 5-7; Pergamon Press Ltd.
Suemitsu, M. et al.; "Ultrahigh-vacuum compatible mirror-polished aluminum-alloy surface: Observation of surface-roughness-correlated outgassing rates"; Journal of Vacuum Science Technology; Bearing a date of May/Jun. 1992; pp. 570-572; vol. 10; No. 3; American Vacuum Society.

Suttmeier, Chris; "Warm Mix Asphalt: A Cooler Alternative"; Material Matters—Around the Hot Mix Industry; Spring 2006; pp. 21-22; Peckham Materials Corporation.
Tatenuma, K. et al.; "Acquisition of clean ultrahigh vacuum using chemical treatment"; Journal of Vacuum Science Technology; Bearing a date of Jul./Aug. 1998; pp. 2693-2697; vol. 16; No. 4; American Vacuum Society.
Tatenuma, K.; "Quick acquisition of clean ultrahigh vacuum by chemical process technology"; Journal of Vacuum Science Technology; Bearing a date of Jul./Aug. 1993; pp. 2693-2697; vol. 11; No. 4; American Vacuum Society.
Techathawat, Sirirat et al.; "Exposure to heat and freezing in the vaccine cold chain in Thailand"; Vaccine; 2007; p. 1328-1333; vol. 25; Elsevier Ltd.
Thakker, Yogini et al.; "Storage of Vaccines in the Community: Weak Link in the Cold Chain?"; British Medical Journal; Mar. 21, 1992; pp. 756-758; vol. 304, No. 6829; BMJ Publishing Group.
Thompson, Marc T.; "Eddy current magnetic levitation—Models and experiments"; IEEE Potentials; Feb./Mar. 2000; pp. 40-46; IEEE.
Tripathi, A. et al.; "Hydrogen intake capacity of ZrVFe alloy bulk getters"; Vacuum; Bearing a date of Aug. 6, 1997; pp. 1023-1025; vol. 48; No. 12; Elsevier Science Ltd.
"Two Wire Gage / Absolute Pressure Transmitters—Model 415 and 440"; Honeywell Sensotec; printed 2007; pp. 1-2; Located at www.sensotec.com and www.honeywell.com/sensing.
UNICEF Regional Office for Latin America & the Carribean (UNICEF-TACRO); Program for Appropriate Technology in Health (PATH); "Final Report Cold Chain Workshop," Panama City, May 31-Jun. 2, 2006; pp. 1-4 plus cover sheet, table of contents, and annexes A, B and C (22 pages total).
U.S. Department of Health and Human Services, Centers for Disease Control and Prevention; "Recommended Immunization Schedule for Persons Aged 0 Through 6 Years—United States"; Bearing a date of 2009; p. 1.
Vesel, Alenka, et al.; "Oxidation of AISI 304L stainless steel surface with atomic oxygen"; Applied Surface Science; Bearing a date of 2002; pp. 94-103; vol. 200; Elsevier Science B.V.
Wang, Lixia et al.; "Hepatitis B vaccination of newborn infants in rural China: evaluation of a village-based, out-of-cold-chain delivery strategy"; Bulletin of the World Health Organization; Sep. 2007; pp. 688-694; vol. 85, No. 9; World Health Organization.
Watanabe, S. et al.; "Reduction of outgassing rate from residual gas analyzers for extreme high vacuum measurements"; Journal of Vacuum Science Technology; Bearing a date of Nov./Dec. 1996; pp. 3261-3266; vol. 14; No. 6; American Vacuum Society.
Wei, Wei et al.; "Effects of structure and shape on thermal performance of Perforated Multi-Layer Insulation Blankets"; Applied Thermal Engineering; 2009; pp. 1264-1266; vol. 29; Elsevier Ltd.
Wiedemann, C. et al.; "Multi-layer Insulation Literatures Review"; Advances; Printed on May 2, 2011; pp. 1-10; German Aerospace Center.
Williams, Preston; "Greenbox Thermal Management System Refrigerate-able 2 to 8 C Shipping Containers"; Printed on: Feb. 9, 2011; p. 1; located at http://www.puretemp.com/documents/Refrigerateable%202%20to%208%20C%20Shipping%20Containers.pdf.
Wirkas, Theo, et al.; "A vaccine cold chain freezing study in PNG highlights technology needs for hot climate countries"; Vaccine; 2007; pp. 691-697; vol. 25; Elsevier Ltd.
World Health Organization; "Getting started with vaccine vial monitors; Vaccines and Biologicals"; World Health Organization; Dec. 2002; pp. 1-20 plus cover sheets, end sheet, contents pages, abbreviations page; revision history page and acknowledgments page (29 pages total); World Health Organization; located at www.who.int/vaccines-documents.
World Health Organization; "Getting started with vaccine vial monitors—Questions and answers on field operations"; Technical Session on Vaccine Vial Monitors, Mar. 27, 2002, Geneva; pp. 1-17 (p. 2 left intentionally blank); World Health Organization.
World Health Organization; "Guidelines on the international packaging and shipping of vaccines"; Department of Immunization, Vaccines and Biologicals; Dec. 2005; 40 pages; WHO/IVB/05.23.
World Health Organization; "Preventing Freeze Damage to Vaccines: Aide-memoire for prevention of freeze damage to vaccines"; 2007; pp. 1-4; WHO/IVB/07.09; World Health Organization.
World Health Organization; "Temperature sensitivity of vaccines"; Department of Immunization, Vaccines and Biologicals, World Health Organization; Aug. 2006; pp. 1-62 plus cover sheet, pp. i-ix, and end sheet (73 pages total); WHO/IVB/06.10; World Health Organization.
Yamakage, Michiaki; Sasaki, Hideaki; Jeong, Seong-Wook; Iwasaki, Sohshi; Namiki, Akiyoshi; "Safety and Beneficial Effect on Body Core Temperature of Prewarmed Plasma Substitute Hydroxyethyl Starch During Anesthesia" [Abstract]; Anesthesiology; 2004; p. A-1285; vol. 101; ASA.
Yamazaki, K. et al.; "High-speed pumping to UHV"; Vacuum ; Bearing a date of 2010; pp. 756-759; vol. 84; Elsevier Science Ltd.
Young, J. R.; "Outgassing Characteristics of Stainless Steel and Aluminum with Different Surface Treatments"; The Journal of Vacuum Science and Technology; Bearing a date of Oct. 14, 1968; pp. 398-400; vol. 6, No. 3.
Zajec, Bojan, et al.; "Hydrogen bulk states in stainless-steel related to hydrogen release kinetics and associated redistribution phenomena"; Vacuum; Bearing a date of 2001; pp. 447-452; vol. 61; Elsevier Science Ltd.
Zalba, B. et al.; "Review on thermal energy storage with phase change: materials, heat transfer analysis and applications"; Applied Thermal Engineering; Bearing a date of 2003; pp. 251-283; vol. 23; Elsevier Science Ltd.
Zhitomirskij, I.S. et al.; "A theoretical model of the heat transfer processes in multilayer insulation"; Cryogenics; Bearing a date of May 1979; pp. 265-268; IPC Business Press.
Zhu, Z. Q.; Howe, D.; "Halbach Permanent Magnet Machines and Applications: A Review"; IEE Proceedings—Electric Power Applications; Jul. 2001; pp. 299-308; vol. 148; No. 4; University of Sheffield, Department of Electronic & Electrical Engineering, Sheffield, United Kingdom.

* cited by examiner

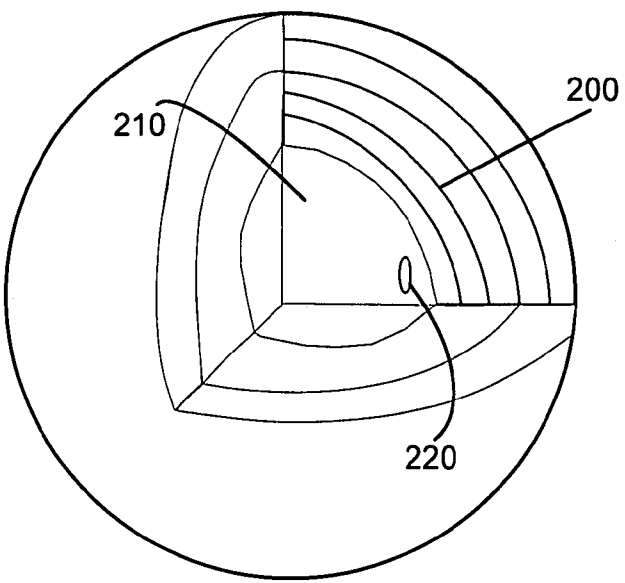
FIG. 2B
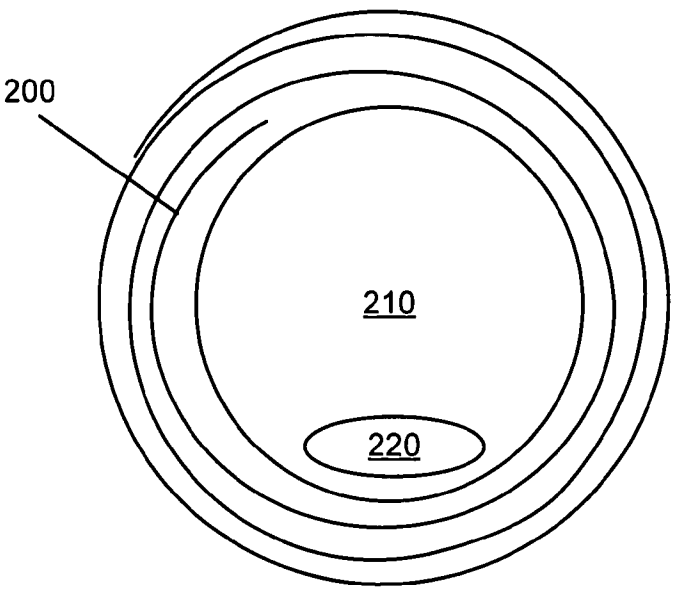
FIG. 2A
FIGS. 2A-2B

FIG. 10

920
Creating a thermal seal around the at least one storage region, wherein the thermal seal includes the at least one layer of first thermal barrier sheet and one or more of the at least one layer of second thermal barrier sheet 1000
Wherein creating a thermal seal around the at least one storage region includes creating a thermal seal around at least one material to be stored 1010
Wherein the at least one material to be stored includes liquid 1020
Wherein the at least one material to be stored includes at least one package 1070
Wherein the at least one material to be stored is in a desired temperature range before completion of the thermal seal 1030
Wherein the at least one material to be stored is in a desired temperature range when it is placed within one or more of the at least one storage region 1040
Wherein creating a thermal seal around the at least one storage region includes sealing both the at least one layer of first thermal barrier sheet and one or more of the at least one layer of second thermal barrier sheet to at least one intermediate material 1050
Wherein creating a thermal seal around the at least one storage region includes attaching together one or more of the at least one layer of first thermal barrier sheet and one or more of the at least one layer of second thermal barrier sheet 1060
Wherein attaching together the at least one layer of first thermal barrier sheet and one or more of the at least one layer of second thermal barrier sheet includes creating structural alterations in one or more of the at least one layer of first thermal barrier sheet and one or more of the at least one layer of second thermal barrier sheet

METHODS OF MANUFACTURING TEMPERATURE-STABILIZED STORAGE CONTAINERS

CROSS-REFERENCE TO RELATED APPLICATIONS

The present application is related to and claims the benefit of the earliest available effective filing date(s) from the following listed application(s) (the "Related Applications") (e.g., claims earliest available priority dates for other than provisional patent applications or claims benefits under 35 USC §119(e) for provisional patent applications, for any and all parent, grandparent, great-grandparent, etc. applications of the Related Application(s)).

RELATED APPLICATIONS

For purposes of the USPTO extra-statutory requirements, the present application constitutes a continuation of U.S. patent application Ser. No. 12/012,490, entitled METHODS OF MANUFACTURING TEMPERATURE-STABILIZED STORAGE CONTAINERS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed Jan. 31, 2008 now U.S. Pat. No. 8,069,680.

For purposes of the USPTO extra-statutory requirements, the present application constitutes a continuation-in-part of U.S. patent application Ser. No. 12/001,757, entitled TEMPERATURE-STABILIZED STORAGE CONTAINERS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed Dec. 11, 2007, which is currently co-pending, or is an application of which a currently co-pending application is entitled to the benefit of the filing date.

For purposes of the USPTO extra-statutory requirements, the present application constitutes a continuation-in-part of U.S. patent application Ser. No. 12/006,088, entitled TEMPERATURE-STABILIZED STORAGE CONTAINERS WITH DIRECTED ACCESS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed Dec. 27, 2007 now U.S. Pat. No. 8,215,518, which is currently co-pending, or is an application of which a currently co-pending application is entitled to the benefit of the filing date.

For purposes of the USPTO extra-statutory requirements, the present application constitutes a continuation-in-part of U.S. patent application Ser. No. 12/006,089, entitled TEMPERATURE-STABILIZED STORAGE SYSTEMS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed Dec. 27, 2007, which is currently co-pending, or is an application of which a currently co-pending application is entitled to the benefit of the filing date.

For purposes of the USPTO extra-statutory requirements, the present application constitutes a continuation-in-part of U.S. patent application Ser. No. 12/008,695, entitled TEMPERATURE-STABILIZED STORAGE CONTAINERS FOR MEDICINALS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed Jan. 10, 2008, which is currently co-pending, or is an application of which a currently co-pending application is entitled to the benefit of the filing date.

The United States Patent Office (USPTO) has published a notice to the effect that the USPTO's computer programs require that patent applicants reference both a serial number and indicate whether an application is a continuation or continuation-in-part. Stephen G. Kunin, Benefit of Prior-Filed Application, USPTO Official Gazette Mar. 18, 2003, available at http://www.uspto.gov/web/offices/com/sol/og/2003/week11/patbene.htm. The present Applicant Entity (hereinafter "Applicant") has provided above a specific reference to the application(s) from which priority is being claimed as recited by statute. Applicant understands that the statute is unambiguous in its specific reference language and does not require either a serial number or any characterization, such as "continuation" or "continuation-in-part," for claiming priority to U.S. patent applications. Notwithstanding the foregoing, Applicant understands that the USPTO's computer programs have certain data entry requirements, and hence Applicant is designating the present application as a continuation-in-part of its parent applications as set forth above, but expressly points out that such designations are not to be construed in any way as any type of commentary and/or admission as to whether or not the present application contains any new matter in addition to the matter of its parent application(s).

All subject matter of the Related Applications and of any and all parent, grandparent, great-grandparent, etc. applications of the Related Applications is incorporated herein by reference to the extent such subject matter is not inconsistent herewith.

SUMMARY

Methods described herein include the manufacture of integrally thermally-sealed storage containers. Some aspects include methods of manufacture including creating at least one indentation in at least one layer of first thermal barrier sheet, wherein the at least one layer of first thermal barrier sheet includes at least one first ultra efficient insulation material and wherein the at least one indentation is in a size and shape substantially conforming with at least one storage region; placing material to be stored within one or more of the at least one indentation; placing at least one layer of second thermal barrier sheet adjacent to the material to be stored, wherein the at least one layer of second thermal barrier sheet includes at least one second ultra efficient insulation material; and creating a thermal seal between at least two layers of thermal barrier sheet, substantially thermally sealing the material to be stored in the at least one storage region. In addition to the foregoing, other method aspects are described in the claims, drawings, and text forming a part of the present disclosure.

In some aspects, methods include wrapping at least one layer of first thermal barrier sheet around at least one storage region, wherein the at least one layer of first thermal barrier sheet includes at least one first ultra efficient insulation material; wrapping at least one layer of second thermal barrier sheet around the at least one storage region, wherein the at least one layer of second thermal barrier sheet includes at least one second ultra efficient insulation material; and creating a thermal seal around the at least one storage region, wherein the thermal seal includes the at least one layer of first thermal barrier sheet and one or more of the at least one layer of second thermal barrier sheet. In addition to the foregoing, other method aspects are described in the claims, drawings, and text forming a part of the present disclosure.

In some aspects, methods include spreading out at least one layer of first thermal barrier sheet, wherein the at least one layer of first thermal barrier sheet includes at least one first ultra efficient insulation material; creating at least one indentation in the at least one layer of first thermal barrier sheet, wherein the at least one indentation is of a size and shape substantially conforming with at least one storage region; placing material to be stored within one or more of the at least one indentation in the at least one layer of first thermal barrier sheet; placing at least one layer of second thermal barrier sheet adjacent to the material to be stored, wherein the at least one layer of second thermal barrier sheet includes at least one second ultra efficient insulation material; wrapping one or more ends of the at least one layer of first thermal barrier sheet and one or more ends of the at least one layer of second thermal barrier sheet with at least one layer of third thermal barrier sheet as part of a creation of a thermal seal. In addition to the foregoing, other method aspects are described in the claims, drawings, and text forming a part of the present disclosure.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

FIG. 2A is a schematic of some aspects of an integrally thermally-sealed storage container.

FIG. 2B is a schematic of some aspects of an integrally thermally-sealed storage container such as that shown in FIG. 2B.

FIG. 10 shows some aspects of the method depicted in FIG. 9.

DETAILED DESCRIPTION

Figure 1:
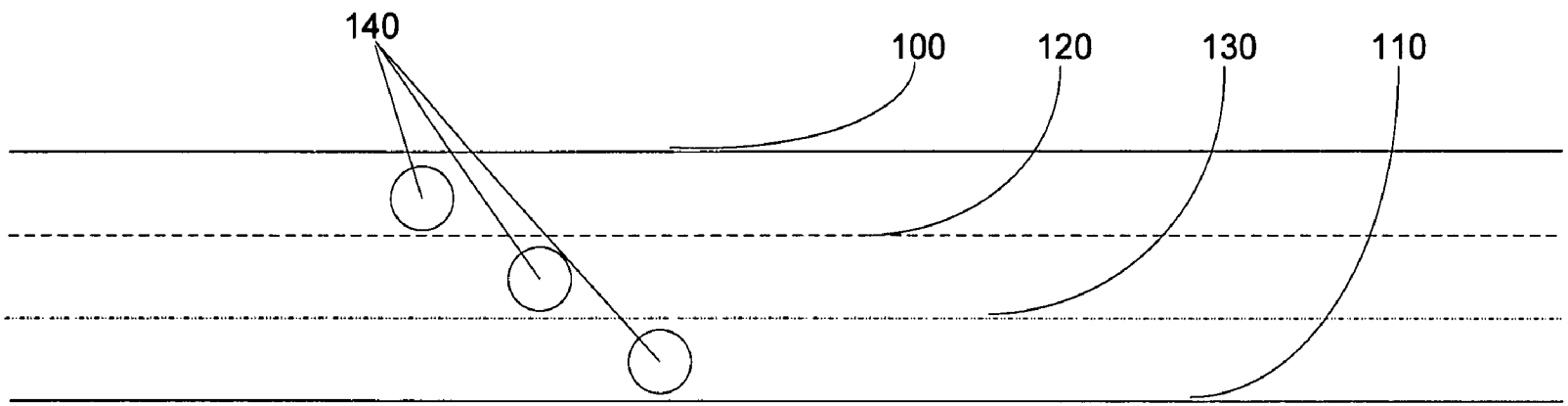
FIG. 1 is a schematic of some aspects of an ultra efficient insulation material.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

In some aspects, methods include manufacturing at least one integrally thermally-sealed container. As used herein, an integrally thermally-sealed container, such as the ones depicted in FIGS. 2, 3 and 4, includes at least one layer of first thermal barrier sheet and at least one layer of second thermal barrier sheet, wherein the layers of thermal barrier sheet include at least one ultra efficient insulation material. An integrally thermally-sealed container, such as the ones depicted in FIGS. 2, 3 and 4, includes at least one substantially thermally-sealed storage region with extremely low heat conductance and extremely low heat radiation transfer between the outside environment of the container and the area internal to the at least one substantially thermally-sealed storage region. An integrally sealed container may have virtually zero heat conductance and virtually zero heat radiation transfer between the outside environment of the container and the inside of the at least one substantially thermally-sealed storage region. As used herein, "integrally sealed" refers to containers that are constituently sealed, for example a container that must be broken open to access the contents of the least one substantially thermally-sealed storage region. In some embodiments, an integrally sealed container may be refurbished or repaired and reused, while in other embodiments an integrally sealed container may be designed for single-use and be disposable.

The term "thermal barrier sheet," as used herein, may include a substantially flat (e.g. sheet-like) material including one or more layers of ultra efficient insulation material of any type or combination of types. A thermal barrier sheet may include one or more type of superinsulation material in addition to one or more layers of ultra efficient insulation material of any type or combination of types. A thermal barrier sheet may include one or more components to stabilize, support or contain one or more layers of ultra efficient insulation material or one or more layers of superinsulation material. For example, a thermal barrier sheet may include one or more layers of structurally stabilizing material, sealing material, protective material, or containment material. For example, a thermal barrier sheet may include one or more layers of fiberglass, metal or plastic in addition to an ultra efficient insulation material.

The term "ultra efficient insulation material," as used herein, may include one or more type of insulation material with extremely low heat conductance and extremely low heat radiation transfer between the surfaces of the insulation material. The ultra efficient insulation material may include, for example, one or more layers of thermally reflective film, high vacuum, aerogel, low thermal conductivity bead-like units, disordered layered crystals, low density solids, or low density foam. In some embodiments, the ultra efficient insulation material includes one or more low density solids such as aerogels, such as those described in, for example: Fricke and Emmerling, Aerogels—preparation, properties, applications, Structure and Bonding 77: 37-87 (1992); and Pekala, Organic aerogels from the polycondensation of resorcinol with formaldehyde, Journal of Materials Science 24: 3221-3227 (1989); each of which are each herein incorporated by reference. As used herein, "low density" may include materials with density from about 0.01 g/cm$^3$ to about 0.10 g/cm$^3$, and materials with density from about 0.005 g/cm$^3$ to about 0.05 g/cm$^3$. In some embodiments, the ultra efficient insulation material includes one or more layers of disordered layered crystals, such as those described in, for example: Chiritescu et al., Ultralow thermal conductivity in disordered, layered $WSe_2$ crystals, Science 315: 351-353 (2007), which is herein incorporated by reference. In some embodiments, the ultra efficient insulation material includes at least two layers of thermal reflective film separated, for example, by at least one of: high vacuum, low thermal conductivity spacer units, low thermal conductivity bead like units, or low density foam. For example, the ultra-efficient insulation material may include at least one multiple layer insulating composite such as described in U.S. Pat. No. 6,485,805 to Smith et al., titled "Multilayer insulation composite," which is herein incorporated by reference. For example, the ultra-efficient insulation material may include at least one metallic sheet insulation system, such as that described in U.S. Pat. No. 5,915,283 to Reed et al., titled "Metallic sheet insulation system," which is herein incorporated by reference. For example, the ultra-efficient insulation material may include at least one thermal insulation system, such as that described in U.S. Pat. No. 6,967,051 to Augustynowicz et al., titled "Thermal insulation systems," which is herein incorporated by reference. For example, the ultra-efficient insulation material may include at least one rigid multilayer material for thermal insulation, such as that described in U.S. Pat. No. 7,001,656 to Maignan et al., titled "Rigid multilayer material for thermal insulation," which is herein incorporated by reference.

In some embodiments, an ultra efficient insulation material includes at least one material described above and at least one superinsulation material. As used herein, a "superinsulation material" may include structures wherein at least two floating thermal radiation shields exist in an evacuated double-wall annulus, closely spaced but thermally separated by at least one poor-conducting fiber-like material.

In some embodiments, an ultra efficient insulation material includes at least two layers of thermal reflective material separated from each other by magnetic suspension. The layers of thermal reflective material may be separated, for example, by magnetic suspension methods including magnetic induction suspension or ferromagnetic suspension. For more information regarding magnetic suspension systems, see Thompson, Eddy current magnetic levitation models and experiments, IEEE Potentials, February/March 2000, 40-44, and Post, Maglev: a new approach, Scientific American, January 2000, 82-87, which are each incorporated herein by reference. Ferromagnetic suspension may include, for example, the use of magnets with a Halbach field distribution. For more information regarding Halbach machine topologies and related applications suitable for use in an embodiment described herein, see Zhu and Howe, Halbach permanent magnet machines and applications: a review, IEE Proc.-Electr. Power Appl. 148: 299-308 (2001), which is herein incorporated by reference.

In reference now to FIG. 1, in some embodiments, an ultra efficient insulation material may include at least one multilayer insulation material. For example, the ultra efficient insulation material may include multilayer insulation material such as that used in space program launch vehicles, including by NASA. See, e.g., Daryabeigi, Thermal analysis and design optimization of multilayer insulation for reentry aerodynamic heating, Journal of Spacecraft and Rockets 39: 509-514 (2002), which is herein incorporated by reference. As illustrated in FIG. 1, in some embodiments, the ultra efficient insulation material may include at least two layers of thermal reflective film 120, 130 separated by low thermal conductivity spacer units 140. The low thermal conductivity spacer units may include, for example, low thermal conductivity bead-like structures, aerogel particles, folds or inserts of thermal reflective film. Although two layers of thermal reflective film are shown in FIG. 1, in some embodiments there may be one layer of thermal reflective film or more than two layers of thermal reflective film. Similarly, there may be variable numbers of low thermal conductivity spacer units 140, including no spacer units. In some embodiments there may be one or more additional layers within or in addition to the ultra efficient insulation material, such as, for example, an outer structural layer 100 or an inner structural layer 110. An inner or an outer structural layer may be made of any material appropriate to the embodiment, for example an inner or an outer structural layer may include: plastic, metal, alloy, composite, or glass. In some embodiments, there may be one or more layers of high vacuum between layers of thermal reflective film.

With reference now to FIGS. 2A and 2B, shown is an example of an integrally thermally-sealed container that may serve as a context for introducing one or more methods described herein. FIGS. 2A and 2B depict an integrally sealed container including a layer of thermal barrier sheet 200 principally defining at least one substantially thermally-sealed storage region 210. FIG. 2A depicts a cross section view of an integrally thermally-sealed container illustrating a layer of thermal barrier sheet 200 wrapped in a circular or ball-like shape to principally define a substantially thermally-sealed storage region 210. FIG. 2B illustrates an external view of the integrally thermally-sealed container shown in FIG. 2A, with a cut-away section depicting the interior of the container. Although the integrally thermally-sealed container depicted in FIGS. 2A and 2B is in a circular or ball-like shape, in some embodiments the container may be in an oblong, egg-like or other shape. As shown in FIGS. 2A and 2B, the container may contain one or more heat sink units 220, or it may contain no heat sink units. The integrally thermally-sealed container, in some embodiments, may include no active cooling units. Although the integrally thermally-sealed container depicted in FIGS. 2A and 2B contains one storage region 210, in some embodiments a container may include multiple storage regions, which may be of similar or different size and shape to each other. In some embodiments, there may be a plurality of storage regions within the container. In some embodiments, an integrally thermally-sealed container may contain additional materials, such as structural reinforcement material to support, protect or enclose one or more layers of thermal barrier sheet.

The term "heat sink unit," as used herein, includes one or more units that absorb thermal energy, such as that described, for example, in U.S. Pat. No. 5,390,734 to Voorhes et al., titled "Heat Sink," U.S. Pat. No. 4,057,101 to Ruka et al., titled "Heat Sink," U.S. Pat. No. 4,003,426 to Best et al., titled "Heat or Thermal Energy Storage Structure," and U.S. Pat. No. 4,976,308 to Faghri titled "Thermal Energy Storage Heat Exchanger," which are each incorporated herein by reference. Heat sink units may include, for example: units containing frozen water or other types of ice; units including frozen material that is generally gaseous at ambient temperature and pressure, such as frozen carbon dioxide ($CO_2$); units including liquid material that is generally gaseous at ambient temperature and pressure, such as liquid nitrogen; units including artificial gels or composites with heat sink properties; units including phase change materials; and units including refrigerants, such as that described, for example, in: U.S. Pat. No. 5,261,241 to Kitahara et al., titled "Refrigerant," U.S. Pat. No. 4,810,403 to Bivens et al., titled "Halocarbon Blends for Refrigerant Use," U.S. Pat. No. 4,428,854 to Enjo et al., titled "Absorption Refrigerant Compositions for Use in Absorption Refrigeration Systems," and U.S. Pat. No. 4,482,465 to Gray, titled "Hydrocarbon-Halocarbon Refrigerant Blends," which are each herein incorporated by reference.

The term "active cooling unit," as used herein, includes conductive and radiative cooling mechanisms that require electricity from an external source to operate. For example, active cooling units may include one or more of: actively powered fans, actively pumped refrigerant systems, thermoelectric systems, active heat pump systems, active vapor-compression refrigeration systems and active heat exchanger systems. The external energy required to operate such mechanisms may originate, for example, from municipal electrical power supplies or electric batteries.

Figure 3:
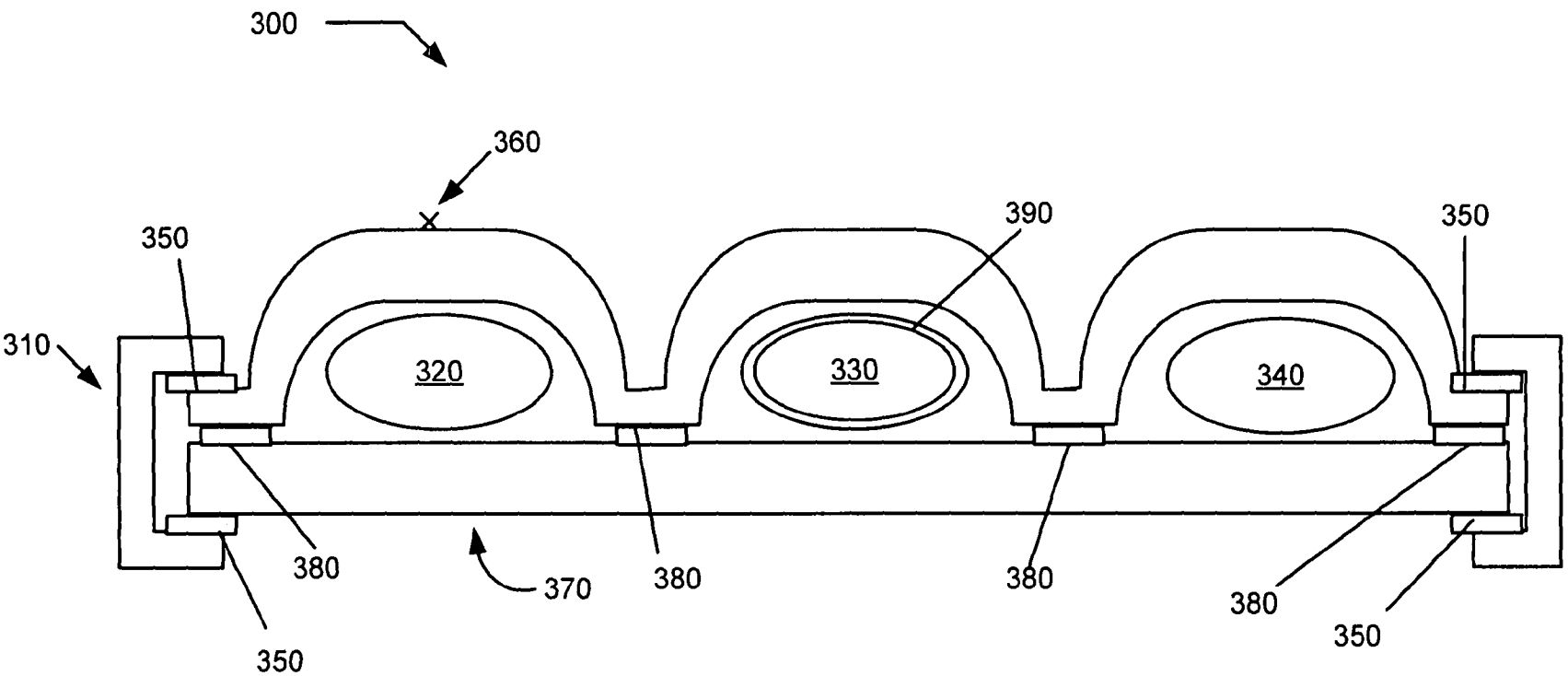
FIG. 3 is a schematic of some aspects of an integrally thermally-sealed storage container.

With reference now to FIG. 3, in some embodiments an integrally thermally-sealed container may include one or more regions of substantially thermally-sealed connections 350, 380, between one or more layers of first thermal barrier sheet 300 and one or more layers of second thermal barrier sheet 370 wherein the one or more regions of substantially thermally-sealed connections 350, 380 and the one or more thermal barrier sheets 300, 370 form at least one integrally thermally-sealed storage region 320, 330, 340. In some embodiments, one or more ends of the at least one layer of first thermal barrier sheet 300 and one or more ends of the at least one layer of second thermal barrier sheet 370 may be wrapped with at least one layer of third thermal barrier sheet 310 as part of the creation of a thermal seal. The substantially thermally-sealed connections may create at least one thermal seal. A thermal seal may provide extremely low heat conductance and extremely low heat radiation transfer between thermally-sealed storage regions. A thermal seal may provide virtually zero heat conductance and virtually zero heat radiation transfer between thermally-sealed storage regions. In some embodiments, a thermal seal will allow less heat leak than the entire remainder of the container. In some embodiments, a thermal seal may double the heat seal relative to the remainder of the structure. For example, the heat leak through a thermal seal may be a factor of about 0.5 to a factor of about 2.0 relative to the heat leak through the remainder of the container. For example, the heat leak through a thermal seal may be a factor of about 0.1 to a factor of about 0.5 relative to the heat leak through the remainder of the container. The substantially thermally-sealed connections may include any material or structure appropriate to the embodiment, for example: glues; adhesives; fasteners; welds; at least one layer of a thermal barrier sheet; at least one layer of an ultra efficient insulation material; or at least one layer of a superinsulation material. In some embodiments, one or more regions of substantially thermally-sealed connections may include physical structure to encourage at least one connection between one or more layer of thermal barrier sheets, for example ridges, notches, strips, tongues, ribs, grooves or indentations on the surface regions of one or more layers of first thermal barrier sheet which mate with ridges, notches, strips, tongues, ribs, grooves or indentations on the surface regions of one or more layers of second thermal barrier sheet to form at least one connection. In some embodiments, there are a plurality of thermally-sealed storage regions 320, 330, 340 within the container. Although the plurality of thermally-sealed storage regions 320, 330, 340 shown in FIG. 3 are of similar size and shape, there may be a plurality of thermally-sealed storage regions in varying sizes and shapes, depending on the embodiment.

In some embodiments, an integrally thermally-sealed container may include one or more structural support materials in addition to or included with one or more layers of thermal barrier sheet. For example, a layer of thermal barrier sheet may include a layer of fiberglass for structural support or protection. For example, an integrally thermally-sealed container may be enclosed by one or more layers of plastic for structural support, protection or to enclose the integrally thermally-sealed container.

Some embodiments include nontoxic lining material within one or more of the at least one thermally-sealed storage region. For example, FIG. 3 depicts nontoxic lining material 390 within storage region 330. Nontoxic lining material may include, for example, material that does not itself react with, or produce residue that may be toxic to, the contents of the at least one thermally-sealed storage region, or material that does not produce residue, or otherwise impart properties to the contents that may be toxic to, the future users of contents of the at least one thermally-sealed storage region. Nontoxic lining material may include lining that maintains the chemical structure of the contents of the at least one thermally-sealed storage region, for example nontoxic lining material may include chemically inert or non-reactive materials. Nontoxic lining material may include material that has been developed for use in, for example, medical, pharmaceutical or food storage applications. Nontoxic lining material may include material that may be cleaned or sterilized, for example lining that may be irradiated, autoclaved, or disinfected. Nontoxic lining material may include material that contains one or more antibacterial, antiviral, antimicrobial, or antipathogen agents. For example, nontoxic lining material may include aldehydes, hypochlorites, oxidizing agents, phenolics, quaternary ammonium compounds, or silver. Nontoxic lining material may include material that is structurally stable in the presence of one or more cleaning or sterilizing compounds or radiation, such as plastic that retains its structural integrity after irradiation, or metal that does not oxidize in the presence of one or more cleaning or sterilizing compounds. Nontoxic lining material may include material that consists of multiple layers, with layers removable for cleaning or sterilization, such as for reuse of at least one thermally-sealed storage region. Nontoxic lining material may include, for example, material including metals, fabrics, papers or plastics.

Some embodiments include at least one marking indicating a region where an integrally thermally-sealed storage container may be broken open to release stored material within one or more of the at least one thermally-sealed storage region. The at least one marking 360 may include superficial markings on the exterior of the container, such as those indicated with superficial colorations on the exterior of the container, for example, markings painted or stamped on the exterior of the container. The at least one marking 360 may include markings that include the interior of the container, including markings that may alter the structure of the container such as scratches or perforations. The at least one marking 360 may include superficial markings on the exterior of the container that indicate one or more locations on the container which are amenable to pressure or force due to structural aspects of the interior of the container which are not visible from the exterior of the container, for example superficial markings that indicate regions where a container may be pushed, twisted, punctured or cut in alignment with interior structures to break open the container to release stored material from one or more of the at least one thermally-sealed storage region.

Figure 4:
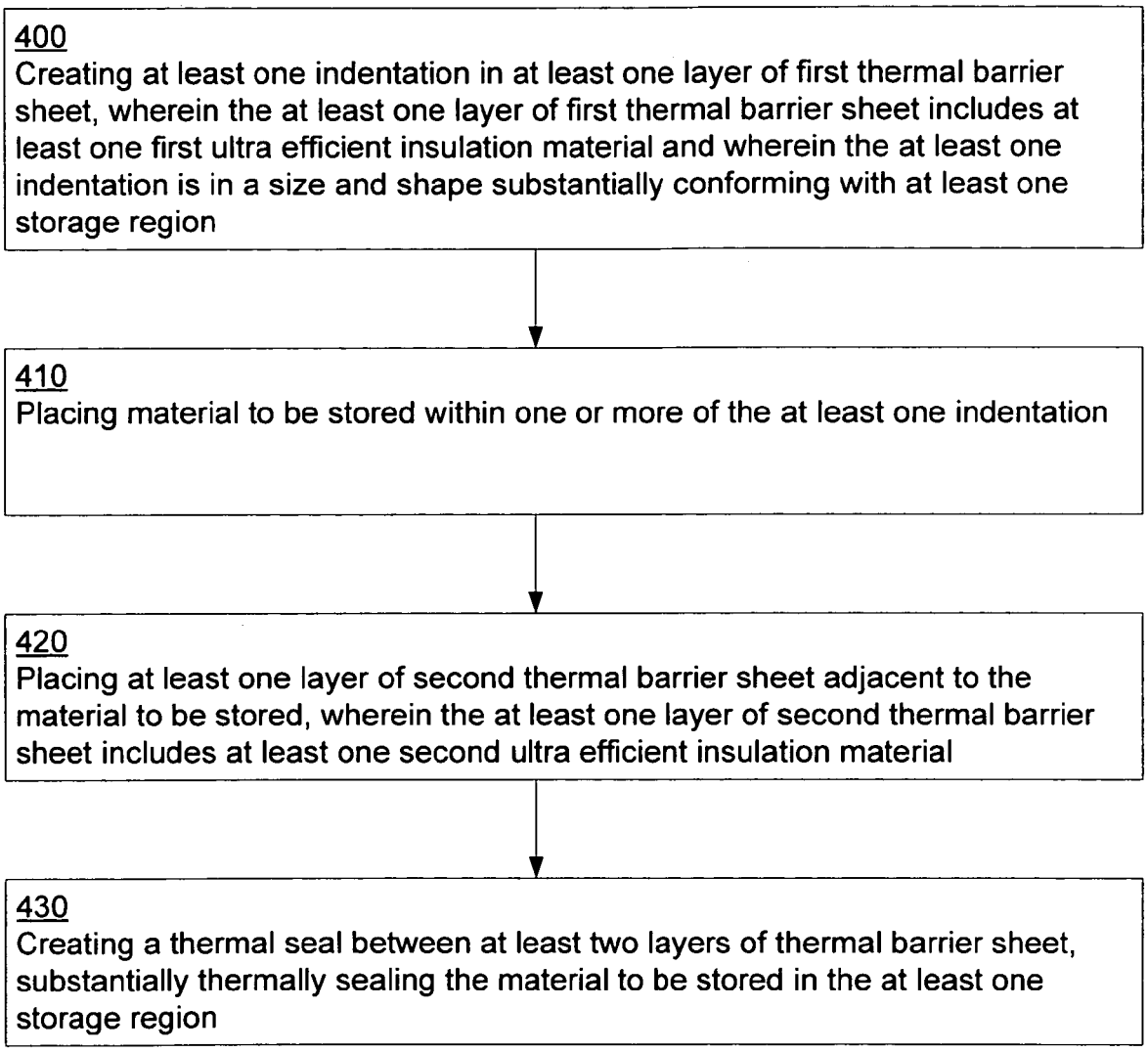
FIG. 4 depicts some aspects of a method.

FIG. 4 depicts aspects of a method. In some embodiments, an illustration of a method of manufacturing an integrally thermally-sealed storage container includes: block 400, creating at least one indentation in at least one layer of first thermal barrier sheet, wherein the at least one layer of first thermal barrier sheet includes at least one first ultra efficient insulation material and wherein the at least one indentation is in a size and shape substantially conforming at least one storage region; block 410, placing material to be stored within one or more of the at least one indentation; block 420, placing at least one layer of second thermal barrier sheet adjacent to the material to be stored, wherein the at least one layer of second thermal barrier sheet includes at least one second ultra efficient insulation material; and block 430, creating a thermal seal between at least two layers of thermal barrier sheet, substantially thermally sealing the material to be stored in the at least one storage region.

The at least one indentation may be created using any means known in the art, for example through the use of heat, physical pressure, vacuum pressure, gravitational pressure, magnetic force or a combination. For example, the at least one layer of first thermal barrier sheet may be placed on top of a framework of desired size and shape, and gravitational pressure used to make at least one indentation in the barrier sheet. For example, the at least one layer of first thermal barrier sheet may be subjected to a vacuum to create at least one indentation. For example, the at least one layer of first thermal barrier sheet may be molded to create at least one indentation. The at least one indentation may be in a size and shape that precisely matches the material to be stored, or it may be slightly larger in one or more dimensions.

The material to be stored may include any material suitable for storage, and may or may not include additional packaging, structural support or multiple materials designated for at least one indentation. In some embodiments, there may be multiple different materials stored in discrete indentations or within a single indentation. In some embodiments, there may be multiple different materials stored in a single storage region or in multiple storage regions. The material to be stored may include, for example, material in liquid, solid, vapor, gaseous, powder, gel, semi-solid or other forms. The material to be stored may include, for example, consumables such as food items or drink items, and may or may not also include additional packaging as appropriate for these items. For example, wine may be packaged in bottles, cans or boxes prior to being placed within one or more of the at least one indentation, or wine may be directly stored within one or more indentations. The material to be stored may include, for example, medicinals such as therapeutics, pharmaceuticals, vaccines, vitamins, supplements, nutraceuticals, or medicines, any of which may or may not be packaged in combination with each other or with additional materials. For example, a vaccine may be packaged in a vial, in a syringe, or a uniject device, and multiple vaccines may be combined together. The material to be stored may include for example, products with a designated use at a specific temperature, such as deicing compounds, thermal assistance items, asphalt patching compounds, or medical products. The material to be stored may be in a desired temperature range when it is placed within one or more of the at least one indentation.

Figure 5:
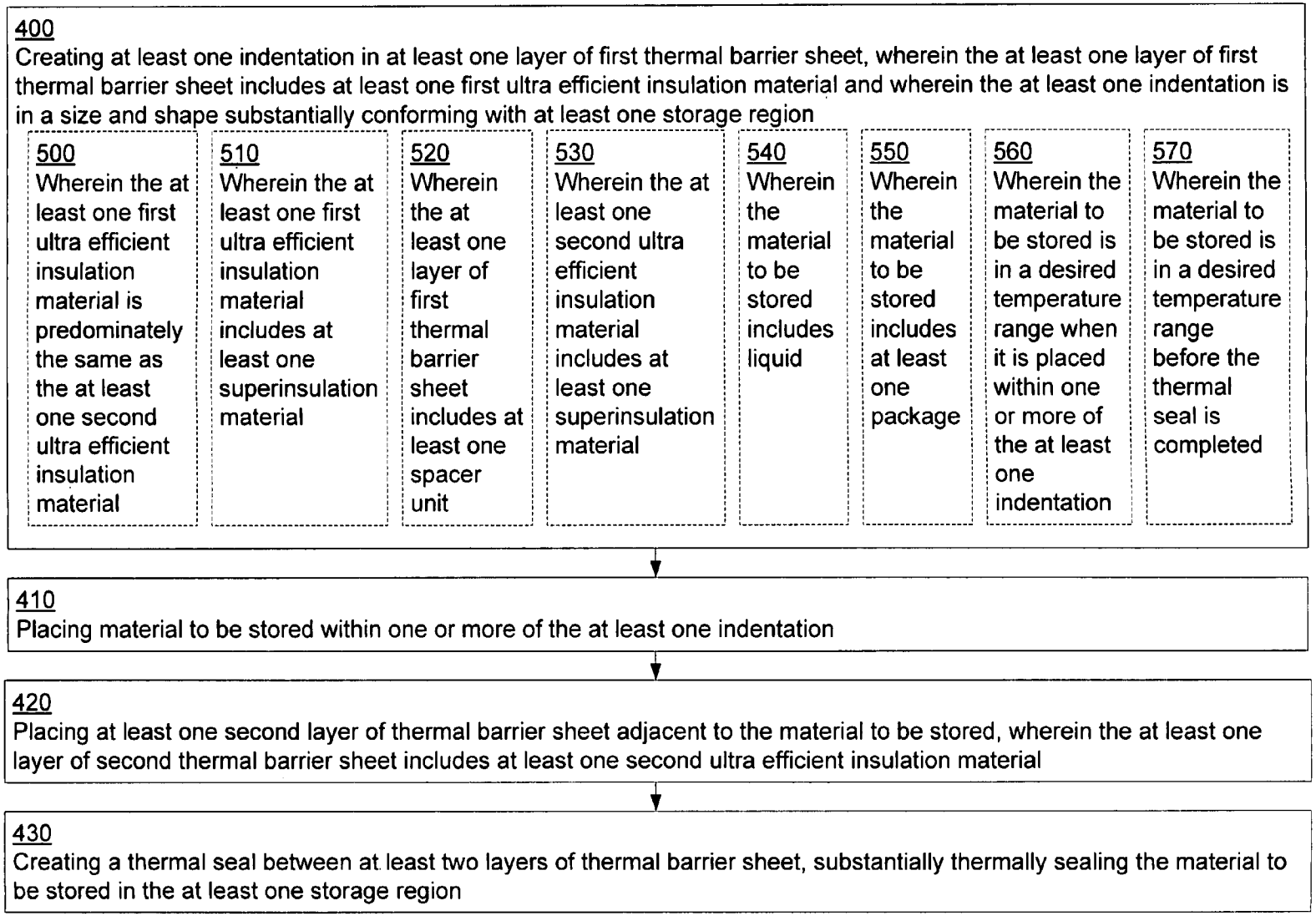
FIG. 5 illustrates some aspects of the method depicted in FIG. 4.

FIG. 5 depicts further aspects of the method illustrated in FIG. 4. In some aspects, block 400, creating at least one indentation in at least one layer of first thermal barrier sheet, wherein the at least one layer of first thermal barrier sheet includes at least one first ultra efficient insulation material and wherein the at least one indentation is in a size and shape substantially conforming with at least one storage region may include one or more of blocks 500, 510, 520, 530, 540, 550, 560, or 570. Block 500 depicts wherein the at least one first ultra efficient insulation material is predominately the same as the at least one second ultra efficient insulation material. For example, the ultra efficient insulation materials may be identical, may be substantially identical, may be partially identical, or may include one or more additional materials. Block 510 shows wherein the at least one first ultra efficient insulation material includes at least one superinsulation material. For example, the at least one first ultra efficient insulation material may include at least one superinsulation material in combination with one or more additional ultra efficient insulation materials. Block 520 illustrates wherein the at least one first layer of thermal barrier sheet includes at least one spacer unit. For example, the at least one first layer of thermal barrier sheet may include a spacer unit as part of at least one layer of ultra efficient insulation material. Block 530 depicts wherein the at least one second ultra efficient insulation material includes at least one superinsulation material. For example, the at least one second ultra efficient insulation material may include at least one superinsulation material in combination with one or more additional ultra efficient insulation materials. Block 540 shows wherein the material to be stored includes liquid. For example, the material to be stored may be entirely liquid, liquid within additional packaging, or a mixture of materials including at least one liquid. Block 550 illustrates wherein the material to be stored includes at least one package. For example, a package may include one or more of the packaging types described herein, including cans, bottles, boxes, bags, medical packaging, wrappers or a combination. Block 560 depicts wherein the material to be stored is in a desired temperature range when it is placed within one or more of the at least one indentation. For example, the material to be stored may be in the range of 2° C. to 8° C., the material to be stored may be frozen, the material to be stored may be at or near boiling, the material to be stored may be in a temperature range that retains the material in a specific state such as frozen, liquid or gas. The material to be stored may be in a desired temperature range that preserves its character or composition, or the material to be stored may be in a desired temperature range for immediate use after the container is opened. Block 570 shows wherein the material to be stored is in a desired temperature range before the thermal seal is completed. For example, the material to be stored may be in the range of 2° C. to 8° C., the material to be stored may be frozen, the material to be stored may be at or near boiling, the material to be stored may be in a temperature range that retains the material in a specific state such as frozen, liquid or gas. The material to be stored may be in a desired temperature range that preserves its character or composition, or the material to be stored may be in a desired temperature range for immediate use after the container is opened. The material may be at a slightly different temperature range when it is placed into one or more of the at least one indentation, and then either warmed or cooled to a desired temperature range before the thermal seal is completed. For example, the material to be stored may be frozen when it is placed into one or more of the at least one indentation, then warmed to a near freezing or above freezing temperature range before the thermal seal is completed. For example, the material to be stored may be within an above freezing temperature range when it is placed into one or more of the at least one indentation, and then cooled to a frozen temperature range before the thermal seal is completed.

Figure 6:
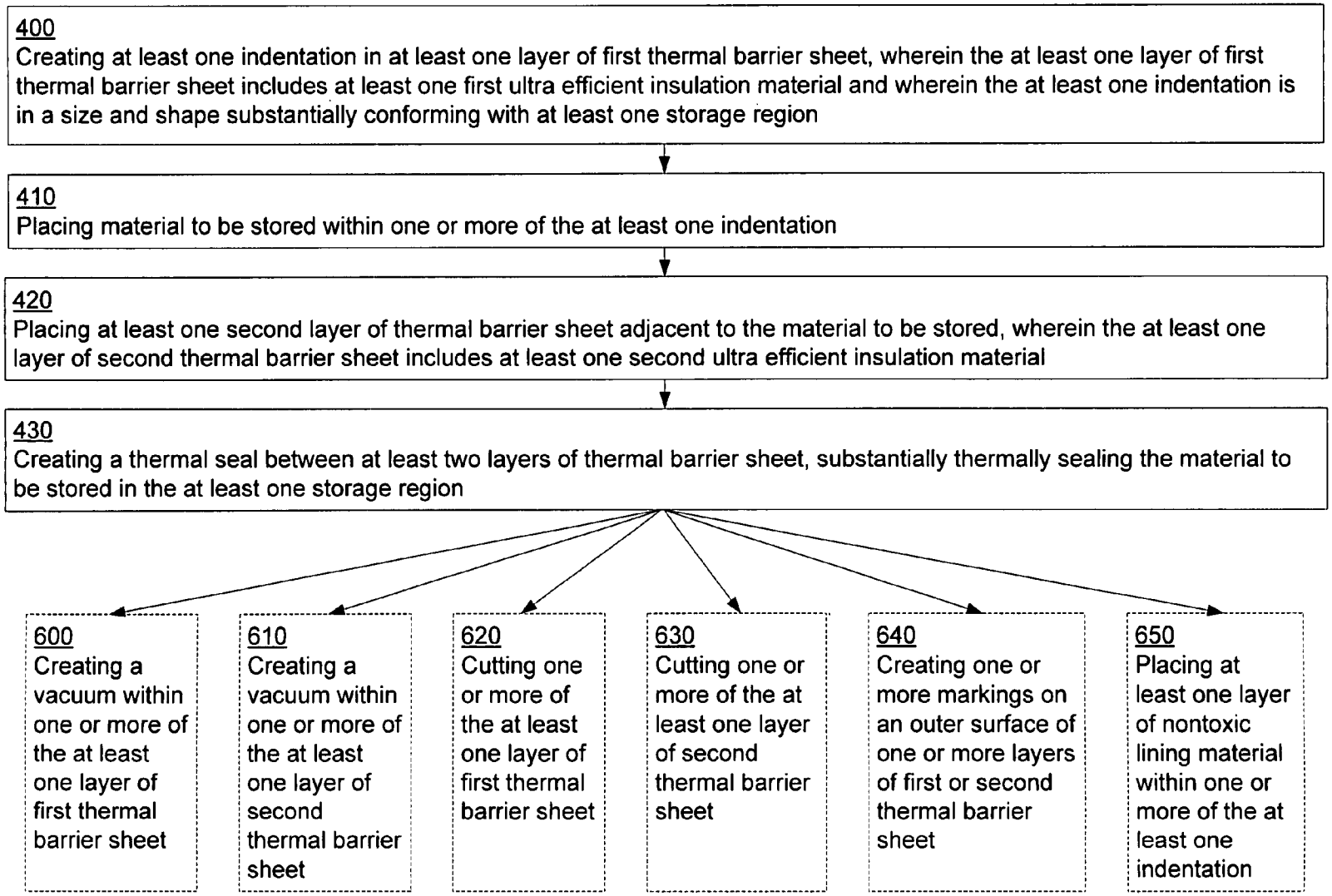
FIG. 6 shows some aspects of the method depicted in FIG. 4.

FIG. 6 illustrates aspects of the method depicted in FIG. 4. In some embodiments, the method depiction may include one or more optional blocks 600, 610, 620, 630, 640 or 650. Block 600 illustrates creating a vacuum within one or more of the at least one layer of first thermal barrier sheet. For example, creating a vacuum between layers of first thermal barrier sheet or within layers of material included within a single layer of first thermal barrier sheet. Block 610 shows creating a vacuum within one or more of the at least one layer of second thermal barrier sheet. For example, creating a vacuum between layers of second thermal barrier sheet or within layers of material included within a single layer of second thermal barrier sheet. Block 620 depicts cutting one or more of the at least one layer of first thermal barrier sheet. Cutting one or more of the at least one first layer of thermal barrier sheet may include, for example, completely cutting through the entire thermal barrier sheet, partially cutting through some portion of the at least one layer of first thermal barrier sheet, or scoring some portion of the at least one layer of first thermal barrier sheet. Block 630 illustrates cutting one or more of the at least one layer of second thermal barrier sheet. Cutting one or more of the at least one layer of second thermal barrier sheet may include, for example, completely cutting through the entire thermal barrier sheet, partially cutting through some portion of the at least one layer of second thermal barrier sheet, or scoring some portion of the at least one layer of second thermal barrier sheet. Block 640 depicts creating one or more markings on an outer surface of one or more layer of first or second thermal barrier sheet. The one or more markings may include superficial markings on the exterior of the container, such as those indicated with superficial colorations on the exterior of the container, for example, markings painted or stamped on the exterior of the container. The one or more markings may include markings that include the interior of the container, including markings that may alter the structure of the container such as scratches or perforations. The one or more markings may include superficial markings on the exterior of the container that indicate one or more locations on the container which are amenable to pressure or force due to structural aspects of the interior of the container which are not visible from the exterior of the container, for example superficial markings that indicate regions where a container may be pushed, twisted, punctured or cut in alignment with interior structures to break open the container to release stored material from one or more of the at least one substantially thermally sealed storage region. Block 650 shows placing at least one layer of nontoxic lining material within one or more of the at least one indentation.

Figure 7:
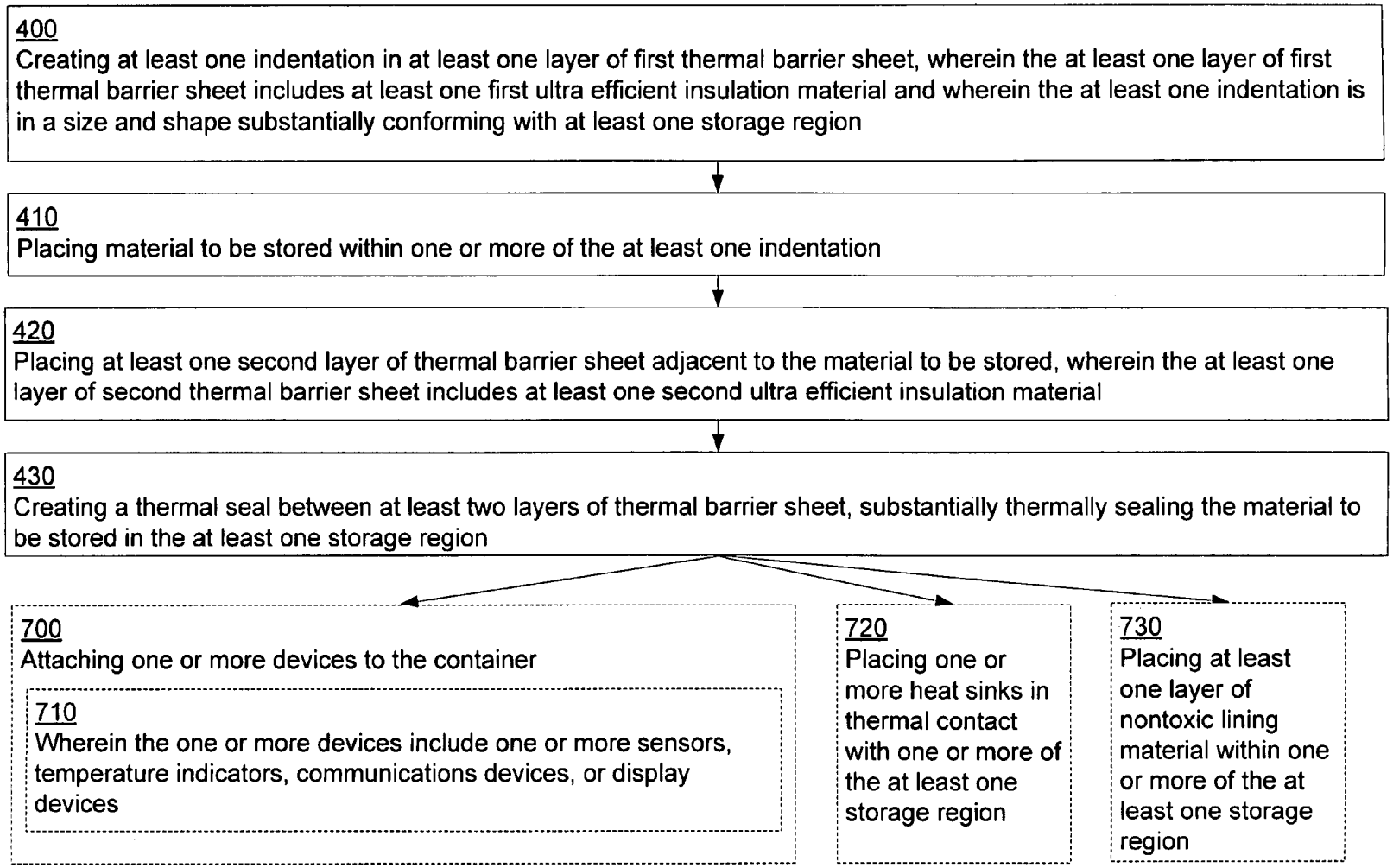
FIG. 7 illustrates some aspects of the method depicted in FIG. 4.

FIG. 7 shows further aspects of the method depicted in FIG. 4. In some embodiments, the method may include one or more of optional blocks 700, 710, 720, or 730. Block 700 depicts attaching one or more devices to the container. Block 700 may include block 710, which illustrates wherein the one or more devices includes one or more sensors, temperature indicators, communications devices or display devices. For example, one or more devices may be attached by any means appropriate to the embodiment to the exterior, interior or within the structure of the container. An attachment may be made by glues, adhesives, welds, structural alterations such as crimps or folds, or rivets. For example, a chemical temperature monitoring strip may be attached to the exterior of the container. For example, a temperature sensor may be attached to the interior of at least one indentation. Block 720 shows placing one or more heat sinks in thermal contact with one or more of the at least one storage region. For example, one or more heat sinks may be placed within the at least one storage region, or one or more heat sinks may be placed at another location and thermally connected to the at least one storage region through a thermally conductive material, such as air, water, thermally conductive metal or a combination of materials. Heat sink units may be placed in thermal contact with one or more of the at least one storage region in conjunction with the material to be stored, for example if a heat sink unit is packaged in conjunction with material to be stored and the combined unit placed within one or more of the at least one indentation. Heat sinks may be placed relative to or within one or more indentations prior to the completion of a thermal seal. For example, a heat sink unit may be placed in an indentation in thermal contact with material to be stored prior to the completion of a thermal seal. Block 730 depicts placing at least one layer of nontoxic lining material within one or more of the at least one storage region. For example, nontoxic lining material may be wrapped around material to be stored prior to its placement in one or more of the at least one indentation. For example, nontoxic lining material may be placed within one or more of the at least one indentation prior to addition of material to be stored. In some embodiments, nontoxic lining material is integral to one or more layers of thermal barrier sheet, while in other embodiments nontoxic lining material is distinct from at least one layer of thermal barrier sheet.

In some embodiments, at least one sensor may include a temperature sensor, such as, for example, chemical sensors, thermometers, bimetallic strips, or thermocouples. An integrally thermally-sealed container may include one or more sensors such as a physical sensor component such as described in U.S. Pat. No. 6,453,749 to Petrovic et al., titled "Physical sensor component," which is herein incorporated by reference. An integrally thermally-sealed container may include one or more sensors such as a pressure sensor such as described in U.S. Pat. No. 5,900,554 to Baba et al., titled "Pressure sensor," which is herein incorporated by reference. An integrally thermally-sealed container may include one or more sensors such as a vertically integrated sensor structure such as described in U.S. Pat. No. 5,600,071 to Sooriakumar et al., titled "Vertically integrated sensor structure and method," which is herein incorporated by reference. An integrally thermally-sealed container may include one or more sensors such as a system for determining a quantity of liquid or fluid within a container, such as described in U.S. Pat. No. 5,138,559 to Kuehl et al., titled "System and method for measuring liquid mass quantity," U.S. Pat. No. 6,050,598 to Upton, titled "Apparatus for and method of monitoring the mass quantity and density of a fluid in a closed container, and a vehicular air bag system incorporating such apparatus," and U.S. Pat. No. 5,245,869 to Clarke et al., titled "High accuracy mass sensor for monitoring fluid quantity in storage tanks," each of which is herein incorporated by reference. An integrally thermally-sealed container may include one or more sensors of radio frequency identification ("RFID") tags to identify material within the at least one substantially thermally sealed storage region. RFID tags are well known in the art, for example in U.S. Pat. No. 5,444,223 to Blama, titled "Radio frequency identification tag and method," which is herein incorporated by reference.

Some embodiments may include at least one temperature indicator. Temperature indicators may be located at multiple locations relative to the container. Temperature indicators may include temperature indicating labels, which may be reversible or irreversible. Temperature indicators suitable for some embodiments may include, for example, the Environmental Indicators sold by ShockWatch Company, with headquarters in Dallas Tex., the Temperature Indicators sold by Cole-Palmer Company of Vernon Hills Ill. and the Time Temperature Indicators sold by 3M Company, with corporate headquarters in St. Paul Minn., the brochures for which are each hereby incorporated by reference. Temperature indicators suitable for some embodiments may include time-temperature indicators, such as those described in U.S. Pat. Nos. 5,709,472 and 6,042,264 to Prusik et al., titled "Time-temperature indicator device and method of manufacture" and U.S. Pat. No. 4,057,029 to Seiter, titled "Time-temperature indicator," each of which is herein incorporated by reference.

Temperature indicators may include, for example, chemically-based indicators, temperature gauges, thermometers, bimetallic strips, or thermocouples.

In some embodiments, a container such as those described herein may include one or more communications devices. The one or more communications devices, may include, for example, one or more recording devices, one or more transmission devices, one or more display devices, or one or more receivers. Communications devices may include, for example, communication devices that allow a user to detect information about the container visually, auditorily, or via signal to a remote device. Some embodiments may include more than one type of communications device, and in some embodiments the devices may be operably linked. For example, some embodiments may contain both a receiver and an operably linked transmission device, so that a signal may be received by the receiver which then causes a transmission to be made from the transmission device. Some embodiments may include more than one type of communications device that are not operably linked. For example, some embodiments may include a transmission device and a display device, wherein the transmission device is not operably linked to the display device. Some embodiments may include communications devices on the exterior of the container, including devices attached to the exterior of the container, devices adjacent to the exterior of the container, or devices located at a distance from the exterior of the container. Some embodiments may include communications devices located within the structure of the container. Some embodiments may include communications devices located within one or more of the at least one indentation. A communications device may include a device similar to a commonly available cellular telephone, or incorporating components which may be integrated within a cellular telephone.

Some embodiments include a container including one or more recording devices. The one or more recording devices may include devices that are magnetic, electronic, chemical, or transcription based recording devices. Depending on the embodiment, there may be a single recording device or a plurality of recording devices. The one or more recording device may record, for example, the temperature from one or more temperature sensor, the result from one or more temperature indicator, or the gaseous pressure, mass, volume or identity of at least one item information from at least one sensor within the container. In some embodiments, the one or more recording devices may be integrated with one or more sensor. For example, in some embodiments there may be one or more temperature sensors which record the highest, lowest or average temperature detected. For example, in some embodiments, there may be one or more mass sensors which record one or more mass changes within the container over time. For example, in some embodiments, there may be one or more gaseous pressure sensors which record one or more gaseous pressure changes within the container over time.

Some embodiments include a container including one or more transmission devices. There may be a single transmission device or a plurality of transmission devices. Transmission devices may be located in a number of positions. The one or more transmission devices may transmit any signal or information, for example, the temperature from one or more temperature sensor, or the gaseous pressure, mass, volume or identity of at least one item or information from at least one sensor within the at least one storage region. In some embodiments, the one or more transmission devices may be integrated with one or more sensor, or one or more recording device. The one or more transmission devices may transmit by any means known in the art, for example, but not limited to, via radio frequency (e.g. RFID tags), magnetic field, electromagnetic radiation, electromagnetic waves, sonic waves, or radioactivity.

In some embodiments an integrally thermally sealed container may include one or more display devices. Display devices may be located at a number of locations relative to the container. In some embodiments, one or more display devices may be integrated with one or more sensor. For example, in some embodiments one or more display devices may show temperature information. In some embodiments, one or more display devices may be integrated with one or more recording devices. For example, a recording device may include a visual printing, such as a graph, which is visualized with a display device, such as a window-like covering. For example, a recording device may include a digital display which indicates some aspects of the information being recorded in real-time or over a time interval. Display devices may be located at a distance and may include, for example, electronic displays or computer displays. In some embodiments, data from one or more transmission device may be stored in an analog or digital medium for later display to a user. For example, data transmitted from one or more transmission device may be stored on a remote computer system for display at a later time as requested by a system or a user.

In some embodiments, an integrally thermally-sealed container may include one or more receivers. For example, one or more receivers may include devices that detect sonic waves, electromagnetic waves, radio signals, electrical signals, magnetic pulses, or radioactivity. Depending on the embodiment, one or more receiver may be located within one or more of the at least one storage region. In some embodiments, one or more receivers may be located within the structure of the container. In some embodiments, the one or more receivers may be located on the exterior of the container. In some embodiments, the one or more receiver may be operably coupled to another device, such as for example one or more display devices, recording devices or transmission devices. For example, a receiver may be operably coupled to a display device on the exterior of the container so that when an appropriate signal is received, the display device indicates data, such as time or temperature data. For example, a receiver may be operably coupled to a transmission device so that when an appropriate signal is received, the transmission device transmits data, such as location, time, or positional data.

The term "heat sink unit," as used herein, includes one or more units that absorb thermal energy, such as that described, for example, in U.S. Pat. No. 5,390,734 to Voorhes et al., titled "Heat Sink," U.S. Pat. No. 4,057,101 to Ruka et al., titled "Heat Sink," U.S. Pat. No. 4,003,426 to Best et al., titled "Heat or Thermal Energy Storage Structure," and U.S. Pat. No. 4,976,308 to Faghri titled "Thermal Energy Storage Heat Exchanger," which are each incorporated herein by reference. Heat sink units may include, for example: units containing frozen water or other types of ice; units including frozen material that is generally gaseous at ambient temperature and pressure, such as frozen carbon dioxide ($CO_2$); units including liquid material that is generally gaseous at ambient temperature and pressure, such as liquid nitrogen; units including artificial gels or composites with heat sink properties; units including phase change materials; and units including refrigerants, such as that described, for example, in: U.S. Pat. No. 5,261,241 to Kitahara et al., titled "Refrigerant," U.S. Pat. No. 4,810,403 to Bivens et al., titled "Halocarbon Blends for Refrigerant Use," U.S. Pat. No. 4,428,854 to Enjo et al., titled "Absorption Refrigerant Compositions for Use in Absorption Refrigeration Systems," and U.S. Pat. No. 4,482,465 to Gray, titled "Hydrocarbon-Halocarbon Refrigerant Blends," which are each herein incorporated by reference. Some embodiments of containers as described herein may include one or more heat sink units, or some may include no heat sink units. Some embodiments may include one or more type of heat sink units. In some embodiments, heat sink units may be removable, for example they may be removed in conjunction with stored material or independently. In some embodiments, heat sink units may be replaceable or rechargeable, for example heat sink units containing frozen water or other types of ice or those containing units including artificial gels or composites with heat sink properties that may be refrozen.

Figure 8:
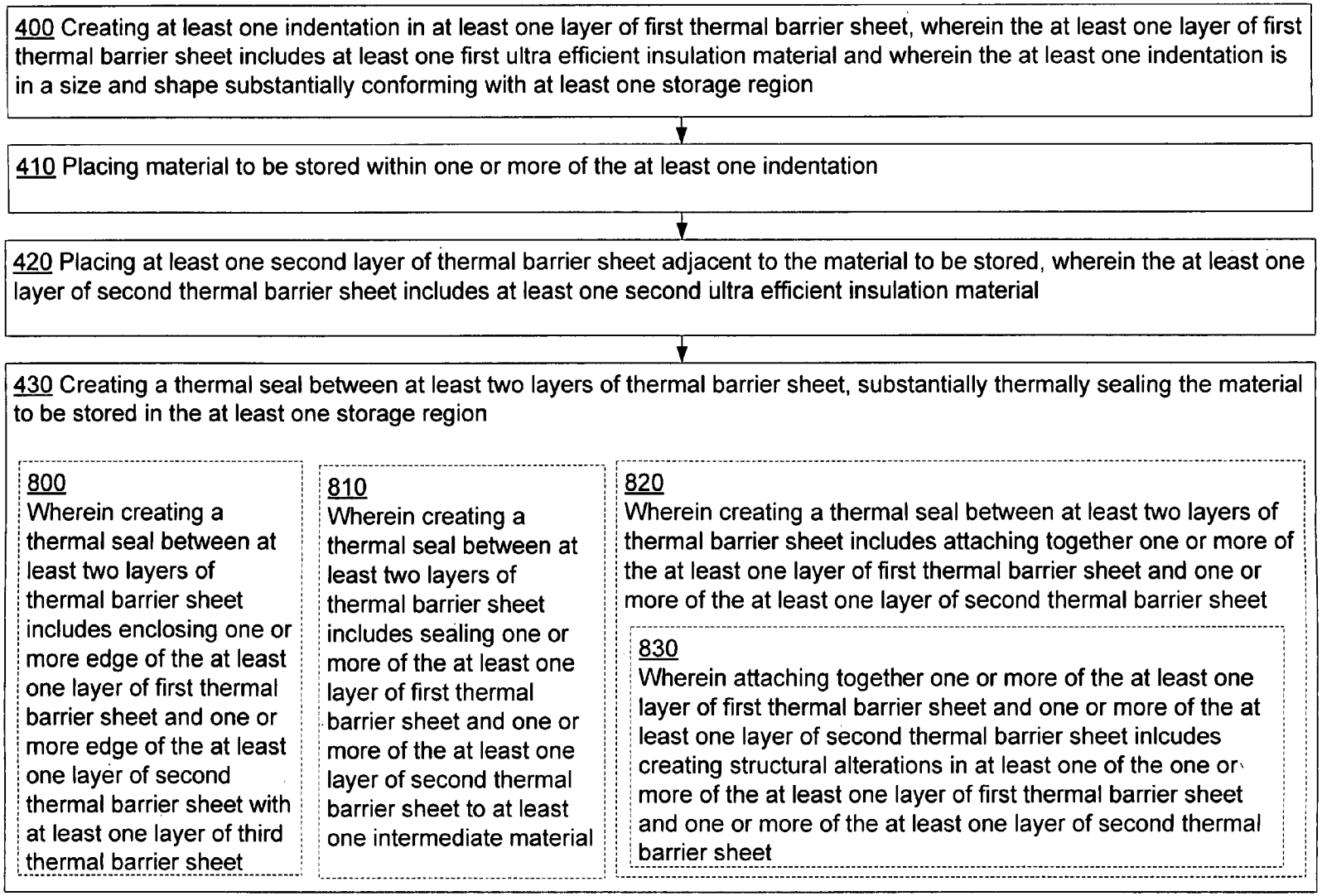
FIG. 8 shows some aspects of the method depicted in FIG. 4.

FIG. 8 illustrates further aspects of the method depicted in FIG. 4. In some embodiments, block 430 depicting creating a thermal seal between at least two layers of thermal barrier sheet, substantially thermally sealing the material to be stored, may include one or more of optional blocks 800, 810, 820, or 830. Block 800 illustrates wherein creating a thermal seal between at least two layers of thermal barrier sheet includes enclosing one or more edge of the at least one layer of first thermal barrier sheet and one or more edge of the at least one layer of second thermal barrier sheet with at least one layer of third thermal barrier sheet. For example, FIG. 3 depicts wherein one or more ends of the at least one layer of first thermal barrier sheet 300 and one or more ends of the at least one layer of second thermal barrier sheet 370 may be wrapped with at least one layer of third thermal barrier sheet 310 as part of the creation of a thermal seal. Block 810 depicts wherein creating a thermal seal between at least two layers of thermal barrier sheet includes sealing one or more of the at least one layer of first thermal barrier sheet and one or more of the at least one layer of second thermal barrier sheet to at least one intermediate material. For example, an intermediate material may include a glue or adhesive support structure, or at least one layer of ultra efficient insulation material or superinsulation material. Block 820 illustrates wherein creating a thermal seal between at least two layers of thermal barrier sheet includes attaching together one or more of the at least one layer of first thermal barrier sheet and one or more of the at least one layer of second thermal barrier sheet. For example, attaching together may be through the use of glues, adhesives, welds, crimps, twists, indentations or other means. Block 830 shows wherein creating a thermal seal between at least two layers of thermal barrier sheet includes creating structural alterations in at least one of the one or more of the at least one layer of first thermal barrier sheet and one or more of the at least one layer of second thermal barrier sheet. For example, ridges, notches, strips, tongues, ribs, grooves or indentations on the surface regions of one or more layers of first thermal barrier sheet may be created to mate with ridges, notches, strips, tongues, ribs, grooves or indentations on the surface regions of one or more of the at least one layer of second thermal barrier sheet.

Figure 9:
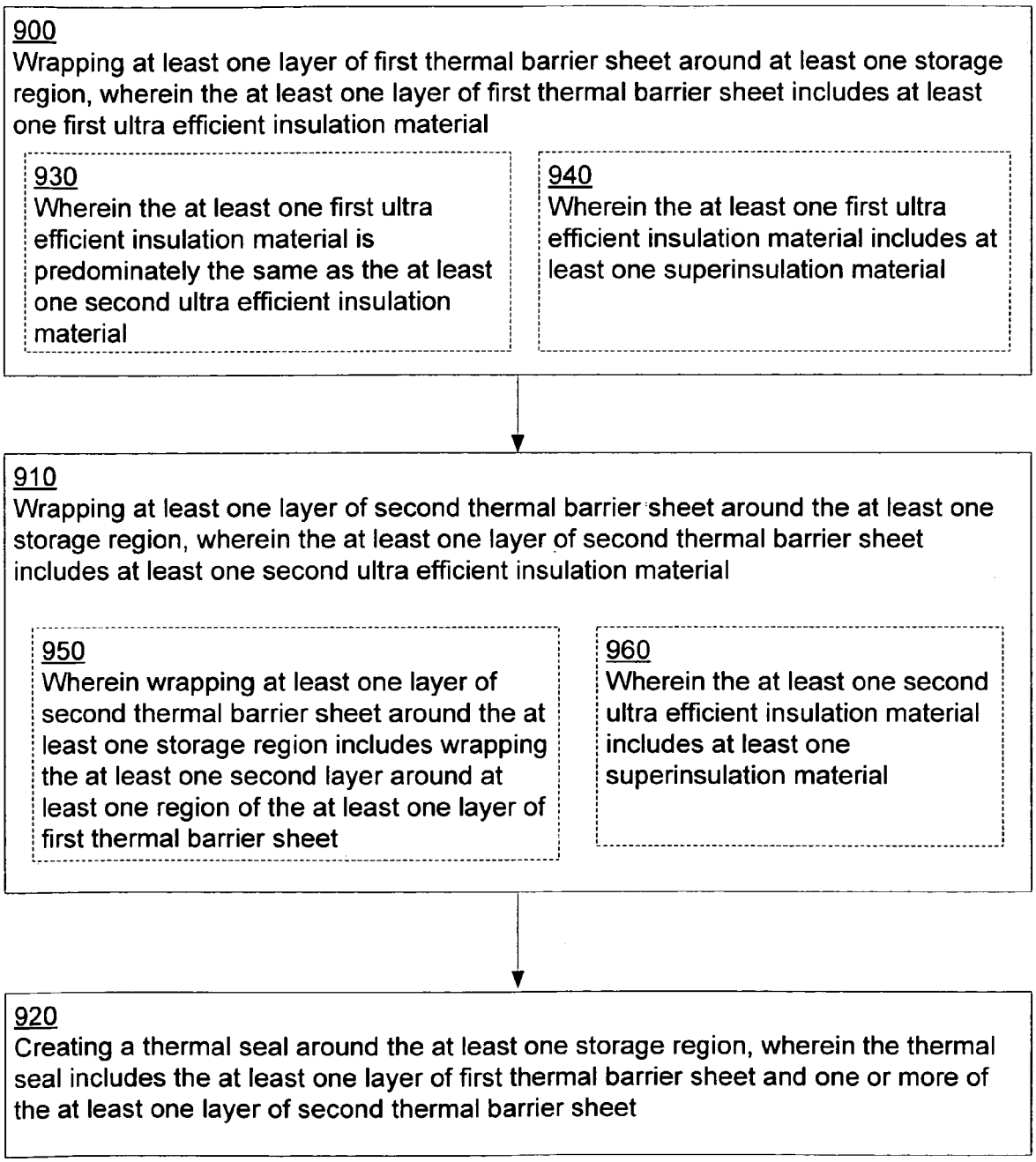
FIG. 9 depicts some aspects of a method.

FIG. 9 depicts some aspects of a method. Block 900 illustrates wrapping a layer of first thermal barrier sheet around a storage region, wherein the layer of first thermal barrier sheet includes at least one first ultra efficient insulation material. Block 910 depicts wrapping at least one layer of second thermal barrier sheet around the storage region, wherein the at least one layer of second thermal barrier sheet includes at least one second ultra efficient insulation material. Block 920 shows creating a thermal seal around the storage region, wherein the thermal seal includes the layer of first thermal barrier sheet and one or more of the at least one layer of second thermal barrier sheet. Block 900 may include one or more of optional blocks 930 and 940. Block 930 depicts wherein the at least one first ultra efficient insulation material is predominately the same as the at least one second ultra efficient insulation material. For example, the ultra efficient insulation materials may be identical, may be substantially identical, may be partially identical, or may include one or more additional materials. Block 940 shows wherein the at least one first ultra efficient insulation material includes at least one superinsulation material. For example, the at least one first ultra efficient insulation material may include at least one superinsulation material in combination with one or more additional ultra efficient insulation materials. Block 910 may include one or more of optional blocks 950 and 960. Block 950 shows wherein wrapping at least one layer of second thermal barrier sheet around the storage region includes wrapping the at least one layer around at least one region of the layer of first thermal barrier sheet. Block 960 illustrates wherein the at least one second ultra efficient insulation material includes at least one superinsulation material. For example, the at least one second ultra efficient insulation material may include at least one superinsulation material in combination with one or more additional ultra efficient insulation materials.

FIG. 10 depicts further aspects of the method illustrated in FIG. 9. In some aspects, block 920, illustrating creating a thermal seal around the storage region, wherein the thermal seal includes the first layer of thermal barrier sheet and one or more of the at least one layer of second thermal barrier sheet, may include one or more of optional blocks 1000, 1010, 1020, 1030, 1040, 1050, 1060 and 1070. Block 1000 shows wherein creating a thermal seal around the storage region includes creating a thermal seal around at least one material to be stored. Block 1000 may include one or more of blocks 1010, 1020, 1030, and 1070. Block 1010 illustrates wherein the at least one material to be stored includes liquid. For example, the material to be stored may be entirely liquid, liquid within additional packaging, or a mixture of materials including at least one liquid. Block 1020 shows wherein the at least one material to be stored includes at least one package. For example, a package may include one or more of the packaging types described herein, including cans, bottles, boxes, bags, medical packaging, wrappers or a combination. Block 1030 depicts wherein the at least one material to be stored is in a desired temperature range when it is placed within one or more of the at least one indentation. For example, the material to be stored may be in the range of 2° C. to 8° C., the material to be stored may be frozen, the material to be stored may be at or near boiling, the material to be stored may be in a temperature range that retains the material in a specific state such as frozen, liquid or gas. The material to be stored may be in a desired temperature range that preserves its character or composition, or the material to be stored may be in a desired temperature range for immediate use after the container is opened. Block 1070 depicts wherein the at least one material to be stored is in a desired temperature range before completion of the thermal seal. For example, the material to be stored may be in the range of 2° C. to 8° C., the material to be stored may be frozen, the material to be stored may be at or near boiling, the material to be stored may be in a temperature range that retains the material in a specific state such as frozen, liquid or gas. The material to be stored may be in a desired temperature range that preserves its character or composition, or the material to be stored may be in a desired temperature range for immediate use after the container is opened. The material may be at a slightly different temperature range when it is placed into one or more of the at least one indentation, and then either warmed or cooled to a desired temperature range before completion of the thermal seal. For example, the material to be stored may be frozen when it is placed into one or more of the at least one indentation, then warmed to a near freezing or above freezing temperature range before completion of the thermal seal. For example, the material to be stored may be within an above freezing temperature range when it is placed into one or more of the at least one indentation, and then cooled to a frozen temperature range before completion of the thermal seal.

Block 1040 illustrates wherein creating a thermal seal around the storage region includes sealing both the layer of first thermal barrier sheet and one or more of the at least one layer of second thermal barrier sheet to an intermediate material. For example, an intermediate material may include a glue or adhesive support structure, or at least one layer of ultra efficient insulation material or superinsulation material. Block 1050 shows wherein creating a thermal seal around the storage region includes attaching together the layer of first thermal barrier sheet and one or more of the at least one layer of second thermal barrier sheet. For example, attaching together may be through the use of glues, adhesives, welds, crimps, twists, indentations or other means. Block 1050 may include block 1060, illustrating wherein attaching together the layer of first thermal barrier sheet and one or more of the at least one layer of second thermal barrier sheet includes creating structural alterations in at least one of the layer of first thermal barrier sheet and one or more of the at least one layer of second thermal barrier sheet. For example, ridges, notches, strips, tongues, ribs, grooves or indentations on the surface regions of one or more layers of first thermal barrier sheet may be created to mate with ridges, notches, strips, tongues, ribs, grooves or indentations on the surface regions of one or more of the at least one layer of second thermal barrier sheet.

Figure 11:
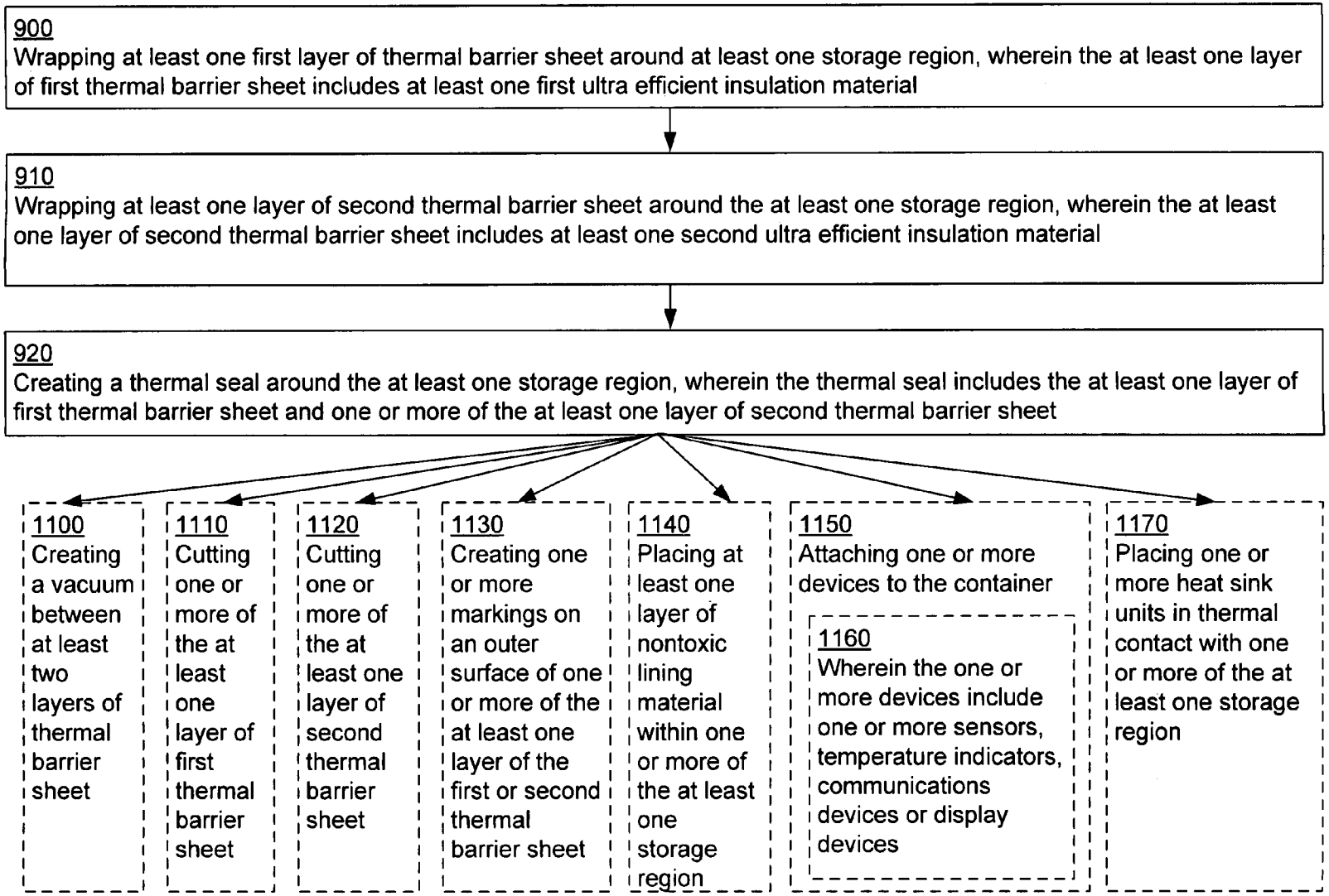
FIG. 11 illustrates some aspects of the method depicted in FIG. 9.

FIG. 11 shows aspects of the method depicted in FIG. 9. A method illustration may include at least one of optional blocks 1100, 1110, 1120, 1130, 1140, 1150, 1160, or 1170. Block 1100 depicts creating a vacuum between at least two layers of thermal barrier sheet. For example, creating a vacuum between layers of thermal barrier sheet or within layers of material included within a single layer of thermal barrier sheet. Block 1110 shows cutting one or more of the at least one layer of first thermal barrier sheet. Block 1120 depicts cutting one or more of the at least one layer of second thermal barrier sheet. Cutting one or more of the at least one layer of first or second thermal barrier sheet may include, for example, completely cutting through the entire thermal barrier sheet, partially cutting through some portion of the at least one layer of thermal barrier sheet, or scoring some portion of the at least one layer of thermal barrier sheet. Block 1130 illustrates creating one or more markings on an outer surface of one or more layer of first or second thermal barrier sheet. The one or more markings may include superficial markings on the exterior of the container, such as those indicated with superficial colorations on the exterior of the container, for example, markings painted or stamped on the exterior of the container. The one or more markings may include markings that include the interior of the container, including markings that may alter the structure of the container such as scratches or perforations. The one or more markings may include superficial markings on the exterior of the container that indicate one or more locations on the container which are amenable to pressure or force due to structural aspects of the interior of the container which are not visible from the exterior of the container, for example superficial markings that indicate regions where a container may be pushed, twisted, punctured or cut in alignment with interior structures to break open the container to release stored material from one or more of the at least one storage region. Block 1140 shows placing at least one layer of nontoxic lining material within one or more of the at least one storage region. Block 1150 illustrates attaching one or more devices to the container. For example, one or more devices may be attached by any means appropriate to the embodiment to the exterior, interior or within the structure of the container. An attachment may be made by glues, adhesives, welds, or structural alterations such as crimps or folds, or rivets. For example, a chemical temperature monitoring strip may be attached to the exterior of the container. For example, a temperature sensor may be attached to the interior of at least one indentation, or to material to be stored prior to its placement within one or more indentation. Block 1150 may include block 1160, showing wherein the one or more devices include one or more sensors, temperature indicators, communications devices or display devices. Block 1170 shows placing one or more heat sinks in thermal contact with one or more of the at least one storage region. For example, one or more heat sinks may be placed within one or more of the at least one storage region, or one or more heat sinks may be placed at another location and thermally connected to one or more of the at least one storage region through a thermally conductive material, such as air, water, thermally conductive metal or a combination.

Figure 12:
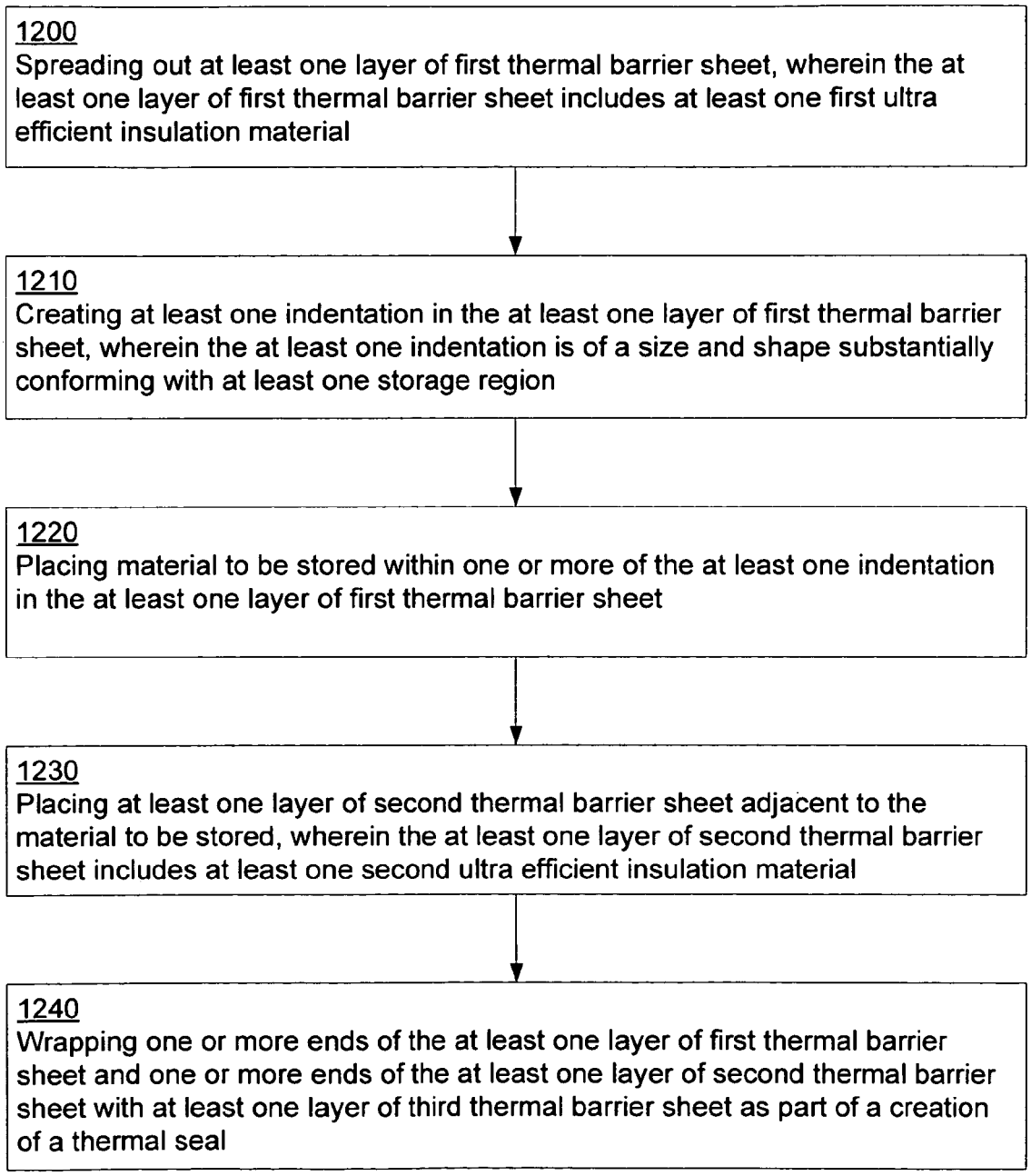
FIG. 12 depicts some aspects of a method.

FIG. 12 illustrates some aspects of a method. Block 1200 depicts spreading out at least one layer of first thermal barrier sheet, wherein the at least one layer of first thermal barrier sheet includes at least one first ultra efficient insulation material. Block 1210 shows creating at least one indentation in the at least one layer of first thermal barrier sheet, wherein the at least one indentation is of a size and shape substantially conforming with at least one storage region. Block 1220 depicts placing material to be stored within one or more of the at least one indentation in the at least one layer of first thermal barrier sheet. Block 1230 illustrates placing at least one layer of second thermal barrier sheet adjacent to the material to be stored, wherein the at least one layer of second thermal barrier sheet includes at least one second ultra efficient insulation material. Block 1240 shows wrapping one or more ends of the at least one layer of first thermal barrier sheet and one or more ends of the at least one layer of second thermal barrier sheet with at least one layer of third thermal barrier sheet as part of a creation of a thermal seal. For example, FIG. 3 depicts wherein one or more ends of the at least one layer of first thermal barrier sheet 300 and one or more ends of the at least one layer of second thermal barrier sheet 370 may be wrapped with at least one layer of third thermal barrier sheet 310 as part of a creation of a thermal seal.

Figure 13:
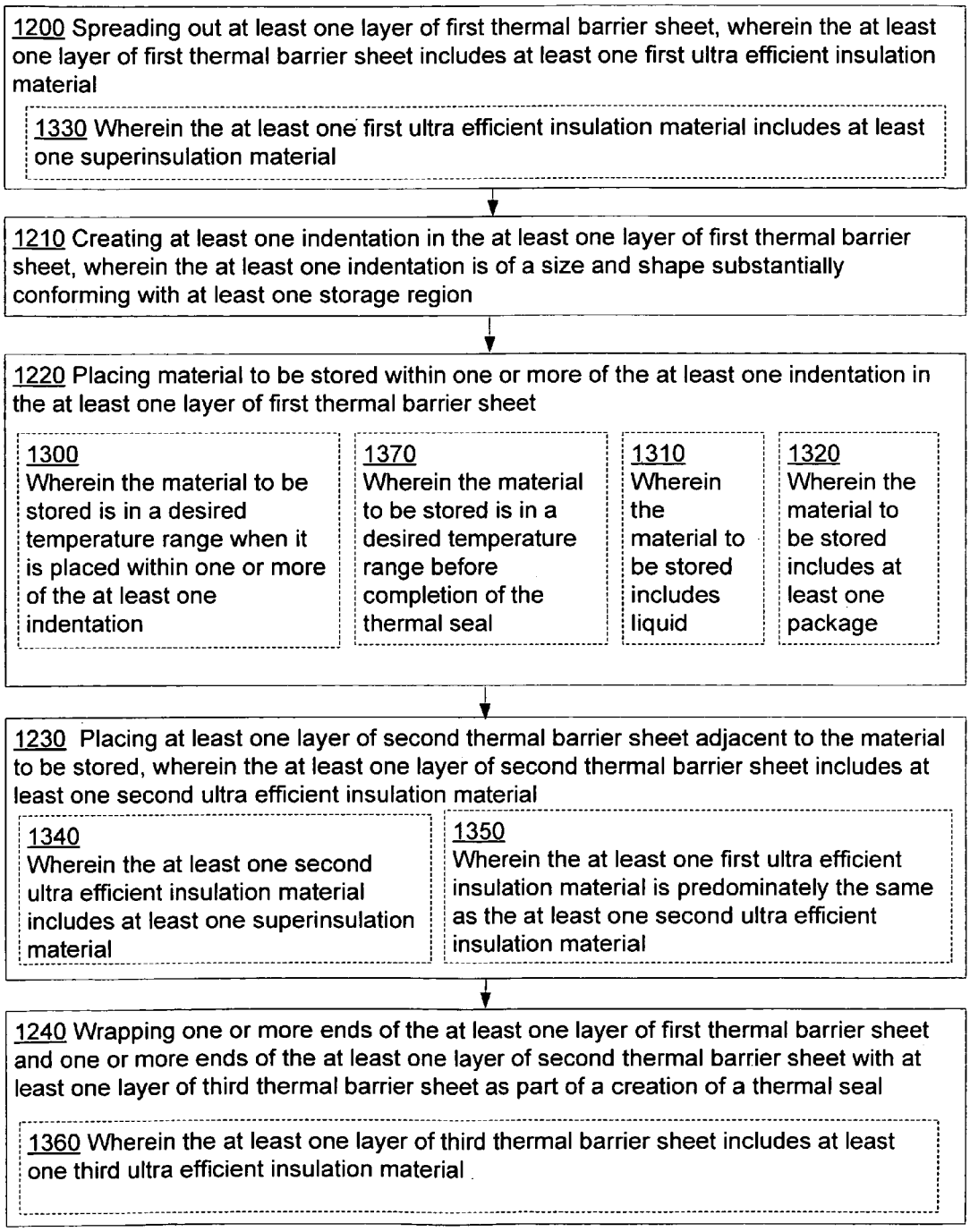
FIG. 13 shows some aspects of the method depicted in FIG. 12.

FIG. 13 depicts additional aspects of the method illustrated in FIG. 12. In some aspects, block 1200, depicting spreading out at least one layer of first thermal barrier sheet, wherein the at least one layer of first thermal barrier sheet includes at least one first ultra efficient insulation material, may include optional block 1330, illustrating wherein the at least one first ultra efficient insulation material includes at least one superinsulation material. For example, the at least one first ultra efficient insulation material may include at least one superinsulation material in combination with one or more additional ultra efficient insulation materials. In some aspects, block 1220, depicting placing material to be stored within one or more of the at least one indentation in the at least one layer of first thermal barrier sheet, may include one or more of optional blocks 1300, 1310, 1320, or 1370. Block 1300 illustrates wherein the material to be stored is in a desired temperature range when it is placed within one or more of the at least one indentation in the at least one layer of first thermal barrier sheet. For example, the material to be stored may be in the range of 2° C. to 8° C., the material to be stored may be frozen, the material to be stored may be at or near boiling, the material to be stored may be in a temperature range that retains the material in a specific state such as frozen, liquid or gas. The material to be stored may be in a desired temperature range that preserves its character or composition, or the material to be stored may be in a desired temperature range for immediate use after the container is opened. Block 1310 illustrates wherein the material to be stored includes liquid. For example, the material to be stored may be entirely liquid, liquid within additional packaging, or a mixture of materials including at least one liquid. Block 1320 illustrates wherein the material to be stored includes at least one package. For example, a package may include one or more of the packaging types described herein, including cans, bottles, boxes, bags, medical packaging, wrappers or a combination. Block 1370 depicts wherein the material to be stored is in a desired temperature range before completion of the thermal seal. For example, the material to be stored may be in the range of 2° C. to 8° C., the material to be stored may be frozen, the material to be stored may be at or near boiling, the material to be stored may be in a temperature range that retains the material in a specific state such as frozen, liquid or gas. The material to be stored may be in a desired temperature range that preserves its character or composition, or the material to be stored may be in a desired temperature range for immediate use after the container is opened. The material may be at a slightly different temperature range when it is placed into one or more of the at least one indentation, and then either warmed or cooled to a desired temperature range before completion of the thermal seal. For example, the material to be stored may be frozen when it is placed into one or more of the at least one indentation, then warmed to a near freezing or above freezing temperature range before completion of the thermal seal. For example, the material to be stored may be within an above freezing temperature range when it is placed into one or more of the at least one indentation, and then cooled to a frozen temperature range before completion of the thermal seal. Block 1230, depicting placing at least one layer of second thermal barrier sheet adjacent to the material to be stored, wherein the second thermal barrier sheet include at least one second ultra efficient insulation material, may include at least one of optional blocks 1340 and 1350. Block 1340 shows wherein the at least one second ultra efficient insulation material includes at least one superinsulation material. For example, the at least one second ultra efficient insulation material may include at least one superinsulation material in combination with one or more additional ultra efficient insulation materials. Block 1350 illustrates wherein the at least one first ultra efficient insulation material is predominately the same as the at least one second ultra efficient insulation material. For example, the ultra efficient insulation materials may be identical, may be substantially identical, may be partially identical, or may include one or more additional materials. Block 1240, illustrating wrapping one or more ends of the at least one layer of first thermal barrier sheet and one or more ends of the at least one layer of second thermal barrier sheet with at least one layer of third thermal barrier sheet as part of the creation of a thermal seal, may include block 1360. Block 1360 depicts wherein the at least one third thermal barrier sheet includes at least one third ultra efficient insulation material.

Figure 14:
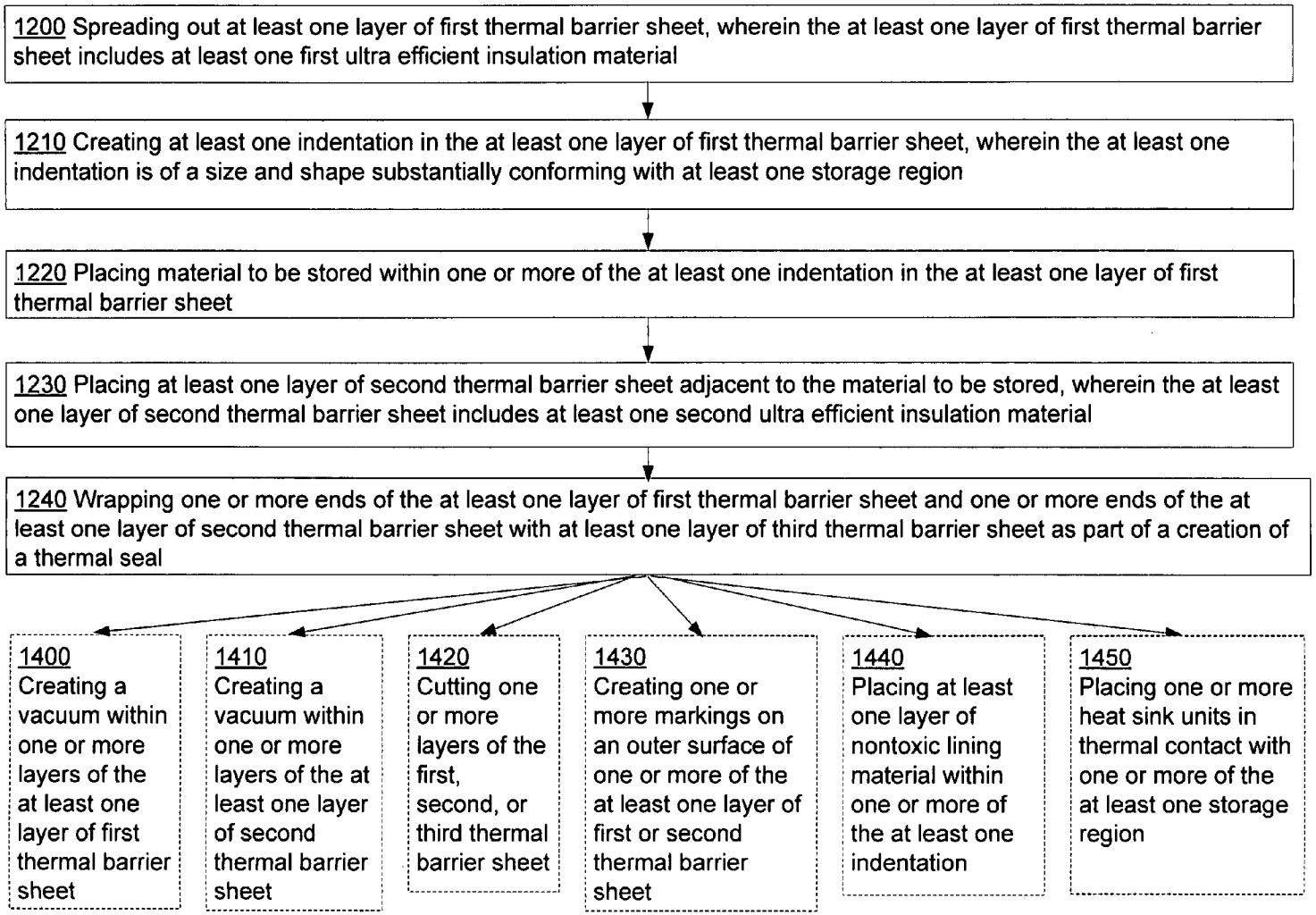
FIG. 14 illustrates some aspects of the method depicted in FIG. 12.

FIG. 14 shows additional aspects of the method illustrated in FIG. 12. Some aspects may include one or more of blocks 1400, 1410, 1420, 1430, 1440, or 1450. Block 1400 shows creating a vacuum within one or more layers of the at least one layer of first thermal barrier sheet. Block 1410 illustrates creating a vacuum within one or more layers of the at least one layer of second thermal barrier sheet. Block 1420 depicts cutting one or more layers of the fist, second or third thermal barrier sheet. Block 1430 illustrates creating one or more markings on an outer surface of one or more layer of first or second thermal barrier sheet. The one or more markings may include superficial markings on the exterior of the container, such as those indicated with superficial colorations on the exterior of the container, for example, markings painted or stamped on the exterior of the container. The one or more markings may include markings that include the interior of the container, including markings that may alter the structure of the container such as scratches or perforations. The one or more markings may include superficial markings on the exterior of the container that indicate one or more locations on the container which are amenable to pressure or force due to structural aspects of the interior of the container which are not visible from the exterior of the container, for example superficial markings that indicate regions where a container may be pushed, twisted, punctured or cut in alignment with interior structures to break open the container to release stored material from one or more of the at least one substantially thermally sealed storage region. Block 1440 shows placing at least one layer of nontoxic lining material within one or more of the at least one indentation. Block 1450 shows placing one or more heat sink units in thermal contact with one or more of the at least one storage region.

Figure 15:
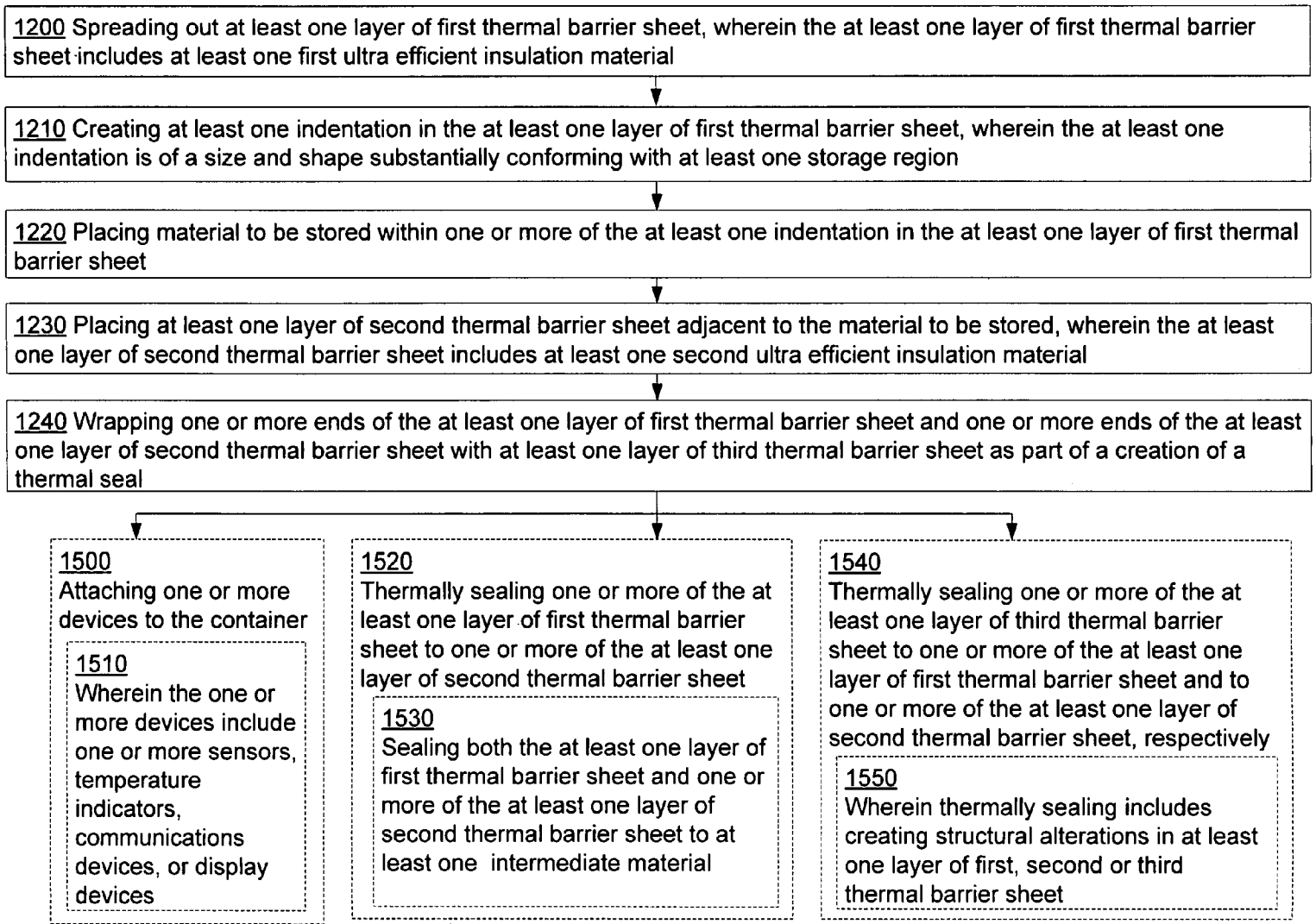
FIG. 15 shows some aspects of the method depicted in FIG. 12.

FIG. 15 shows additional aspects of the method illustrated in FIG. 12. Some aspects may include one or more of blocks 1500, 1510, 1520, 1530, 1540, or 1550. Block 1500 depicts attaching one or more devices to the container. Block 1500 may include block 1510, illustrating wherein the one or more devices include one or more sensors, temperature indicators, communications devices, or display devices. Block 1520 depicts thermally sealing one or more of the at least one layer of first thermal barrier sheet to one or more of the at least one layer of second thermal barrier sheet. Block 1520 may include block 1530, illustrating sealing both the at least one layer of first thermal barrier sheet and one or more of the at least one layer of second thermal barrier sheet to at least one intermediate material. Block 1540 shows thermally sealing one or more of the at least one layer of third thermal barrier sheet to one or more of the at least one layer of first thermal barrier sheet and to one or more of the at least one layer of second thermal barrier sheet, respectively. Block 1540 may include block 1550, wherein thermally sealing includes creating structural alterations in at least one layer of first, second or third thermal barrier sheet.

One skilled in the art will recognize that the herein described components (e.g., steps), devices, and objects and the discussion accompanying them are used as examples for the sake of conceptual clarity and that various configuration modifications are within the skill of those in the art. For example, specific steps listed need not be carried out in the order listed, unless specifically indicated. Consequently, as used herein, the specific exemplars set forth and the accompanying discussion are intended to be representative of their more general classes. In general, use of any specific example herein is also intended to be representative of its class, and the non-inclusion of such specific components (e.g., steps), devices, and objects herein should not be taken as indicating that limitation is desired. Furthermore, the use of particular shapes within a Figure herein is not intended to connote a shape of any particular element. For example, the use of an oval shape for element 220 in FIG. 2 should not be interpreted as meaning that the element 220 in practice should be oval-shaped.

Each of the above U.S. patents, U.S. patent application publications, U.S. patent applications, foreign patents, foreign patent applications and non-patent publications referred to in this specification or listed in any Application Data Sheet, is incorporated herein by reference, to the extent not inconsistent herewith.

In addition to the foregoing, other system aspects are described in the claims, drawings, and text forming a part of the present disclosure.

With respect to the use of substantially any plural or singular terms herein, those having skill in the art can translate from the plural to the singular or from the singular to the plural as is appropriate to the context or application. The various singular/plural permutations are not expressly set forth herein for sake of clarity.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, or A, B, and C together, etc.). It will be further understood by those within the art that virtually any disjunctive word or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method of manufacturing an integrally thermally-sealed storage container, comprising:

wrapping at least one layer of first thermal barrier sheet around at least one storage region including at least one medicinal material to be stored, wherein the at least one layer of first thermal barrier sheet includes at least one first ultra efficient insulation material;

wrapping at least one layer of second thermal barrier sheet around the at least one storage region including at least one medicinal material to be stored, wherein the at least one layer of second thermal barrier sheet includes at least one second ultra efficient insulation material; and creating a thermal seal around the at least one storage region including at least one medicinal material to be stored, wherein the thermal seal includes the at least one layer of first thermal barrier sheet and one or more of the at least one layer of second thermal barrier sheet and the at least one medicinal material to be stored is maintained in the temperature range of 2° C. to 8° C. during creation of the thermal seal.

2. The method as in claim 1, wherein wrapping at least one layer of second thermal barrier sheet around the at least one storage region includes wrapping the at least one second layer around at least one region of the at least one layer of first thermal barrier sheet.

3. The method as in claim 1, wherein the at least one first ultra efficient insulation material includes at least one super-insulation material.

4. The method as in claim 1, wherein the at least one first ultra efficient insulation material is predominately the same as the at least one second ultra efficient insulation material.

5. The method as in claim 1, wherein the at least one second ultra efficient insulation material includes at least one super-insulation material.

6. The method as in claim 1, wherein the at least one medicinal material to be stored includes liquid.

7. The method as in claim 1, wherein the at least one medicinal material to be stored includes at least one package.

8. The method as in claim 1, wherein the at least one medicinal material to be stored is in a desired temperature range when it is placed within one or more of the at least one storage region.

9. The method as in claim 1, wherein the at least one material to be stored is in a desired temperature range before completion of the thermal seal.

10. The method as in claim 1, wherein creating a thermal seal around the at least one storage region comprises:

sealing both the at least one layer of first thermal barrier sheet and one or more of the at least one layer of second thermal barrier sheet to at least one intermediate material.

11. The method as in claim 1, wherein creating a thermal seal around the at least one storage region comprises:

attaching together one or more of the at least one layer of first thermal barrier sheet and one or more of the at least one layer of second thermal barrier sheet.

12. The method as in claim 11, wherein attaching together the at least one layer of first thermal barrier sheet and one or more of the at least one layer of second thermal barrier sheet comprises:

creating structural alterations in one or more of the at least one layer of first thermal barrier sheet and one or more of the at least one layer of second thermal barrier sheet.

13. The method as in claim 1, comprising:

creating a vacuum between at least two layers of thermal barrier sheet.

14. The method as in claim 1, comprising:

cutting one or more of the at least one layer of first thermal barrier sheet.

15. The method as in claim 1, comprising:

cutting one or more of the at least one layer of second thermal barrier sheet.

16. The method as in claim 1, comprising:

creating one or more markings on an outer surface of one or more of the at least one layer of first or second thermal barrier sheet.

17. The method as in claim 1, comprising:

placing at least one layer of nontoxic lining material within one or more of the at least one storage region.

18. The method as in claim 1, comprising:

attaching one or more devices to the container.

19. The method as in claim 18, wherein the one or more devices include one or more:

sensors, temperature indicators, communications devices, or display devices.

20. The method as in claim 1, comprising:

placing one or more heat sink units in thermal contact with one or more of the at least one storage region.

* * * * *